US012740681B2

(12) United States Patent
Song et al.

(10) Patent No.: US 12,740,681 B2
(45) Date of Patent: Sep. 22, 2026

(54) CLEANER SYSTEM

(71) Applicant: LG ELECTRONICS INC., Seoul (KR)

(72) Inventors: Hyunsup Song, Seoul (KR); Jongil Park, Seoul (KR); Jongjin Woo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 641 days.

(21) Appl. No.: 18/038,103

(22) PCT Filed: Dec. 13, 2021

(86) PCT No.: PCT/KR2021/018827
§ 371 (c)(1),
(2) Date: May 22, 2023

(87) PCT Pub. No.: WO2022/131710
PCT Pub. Date: Jun. 23, 2022

(65) Prior Publication Data

US 2024/0000278 A1 Jan. 4, 2024

(30) Foreign Application Priority Data

Dec. 16, 2020 (KR) ..... 10-2020-0176020
Dec. 2, 2021 (KR) ..... 10-2021-0171228

(51) Int. Cl.
*A47L 9/28* (2006.01)
*A47L 9/16* (2006.01)
*A47L 9/32* (2006.01)

(52) U.S. Cl.
CPC ..... *A47L 9/2873* (2013.01); *A47L 9/1683* (2013.01); *A47L 9/325* (2013.01); *A47L 2201/024* (2013.01)

(58) Field of Classification Search
CPC ..... A47L 9/2873; A47L 9/1683; A47L 9/325; A47L 2201/024
See application file for complete search history.

(56) References Cited

U.S. PATENT DOCUMENTS 10,463,215 B2 * 11/2019 Morin ..... A47L 9/2842
2012/0060320 A1 * 3/2012 Lee ..... A47L 9/20 15/347

(Continued)

FOREIGN PATENT DOCUMENTS

CN 102334943 2/2012
CN 106923745 7/2017

(Continued)

OTHER PUBLICATIONS

DE 102019002827 A1—English Machine Translation (Year: 2020).*

(Continued)

*Primary Examiner* — Marc Carlson
(74) *Attorney, Agent, or Firm* — KED & ASSOCIATES, LLP

(57) ABSTRACT

The present disclosure relates to a cleaner system to which both a stick cleaner and a robotic cleaner can be coupled. According to the cleaner system according to the embodiment of the present disclosure, the first station to which the first cleaner is coupled and the second station to which the second cleaner is coupled are included, so that it is possible to remove the inconvenience for a user to empty the dust in the dust bin of the first cleaner and/or the second cleaner each time.

18 Claims, 27 Drawing Sheets

(56) References Cited

U.S. PATENT DOCUMENTS

| | | | | |
|---|---|---|---|---|
| 2018/0125314 | A1 | 5/2018 | Kim et al. | |
| 2020/0329933 | A1 | 10/2020 | Hackert et al. | |
| 2022/0233991 | A1 * | 7/2022 | Conrad | F24F 8/00 |

FOREIGN PATENT DOCUMENTS

| | | | | | |
|---|---|---|---|---|---|
| DE | 10-2019-002827 | | | 10/2020 | |
| DE | 102019002827 | A1 | * | 10/2020 | A47L 9/0063 |
| DE | 102019004417 | A1 | * | 12/2020 | G01F 23/14 |
| EP | 3033982 | | | 4/2019 | |
| GB | 2618280 | A | * | 11/2023 | H02J 7/0042 |
| JP | 2016-116852 | | | 6/2016 | |
| JP | 2016116852 | A | * | 6/2016 | A47L 9/149 |
| JP | 2018-522613 | | | 8/2018 | |
| KR | 100463215 | B1 | * | 12/2004 | B21C 23/085 |
| KR | 10-2009-0020755 | | | 2/2009 | |
| KR | 10-2012-0007943 | | | 1/2012 | |
| KR | 10-2017-0126377 | | | 11/2017 | |
| KR | 10-2018-0057491 | | | 5/2018 | |
| KR | 20180057491 | A | * | 5/2018 | A47L 9/2878 |
| KR | 10-2020-0074001 | | | 6/2020 | |
| KR | 10-2020-0074054 | | | 6/2020 | |
| KR | 20200074001 | A | * | 6/2020 | A47L 9/2873 |
| KR | 20200074054 | A | * | 6/2020 | A47L 9/2873 |
| WO | WO-2021215842 | A1 | * | 10/2021 | A47L 9/2873 |

OTHER PUBLICATIONS

European Search Report dated Sep. 10, 2025 issued in Application No. 21907014.1.

International Search Report dated Mar. 28, 2022 issued in Application No. PCT/KR2021/018827.

Korean Office Action dated Jan. 2, 2026 issued in Application No. 10-2021-0171228.

Chinese Office Action dated Mar. 19, 2026 issued in Application No. 202180079984.5.

* cited by examiner

[FIG. 1]
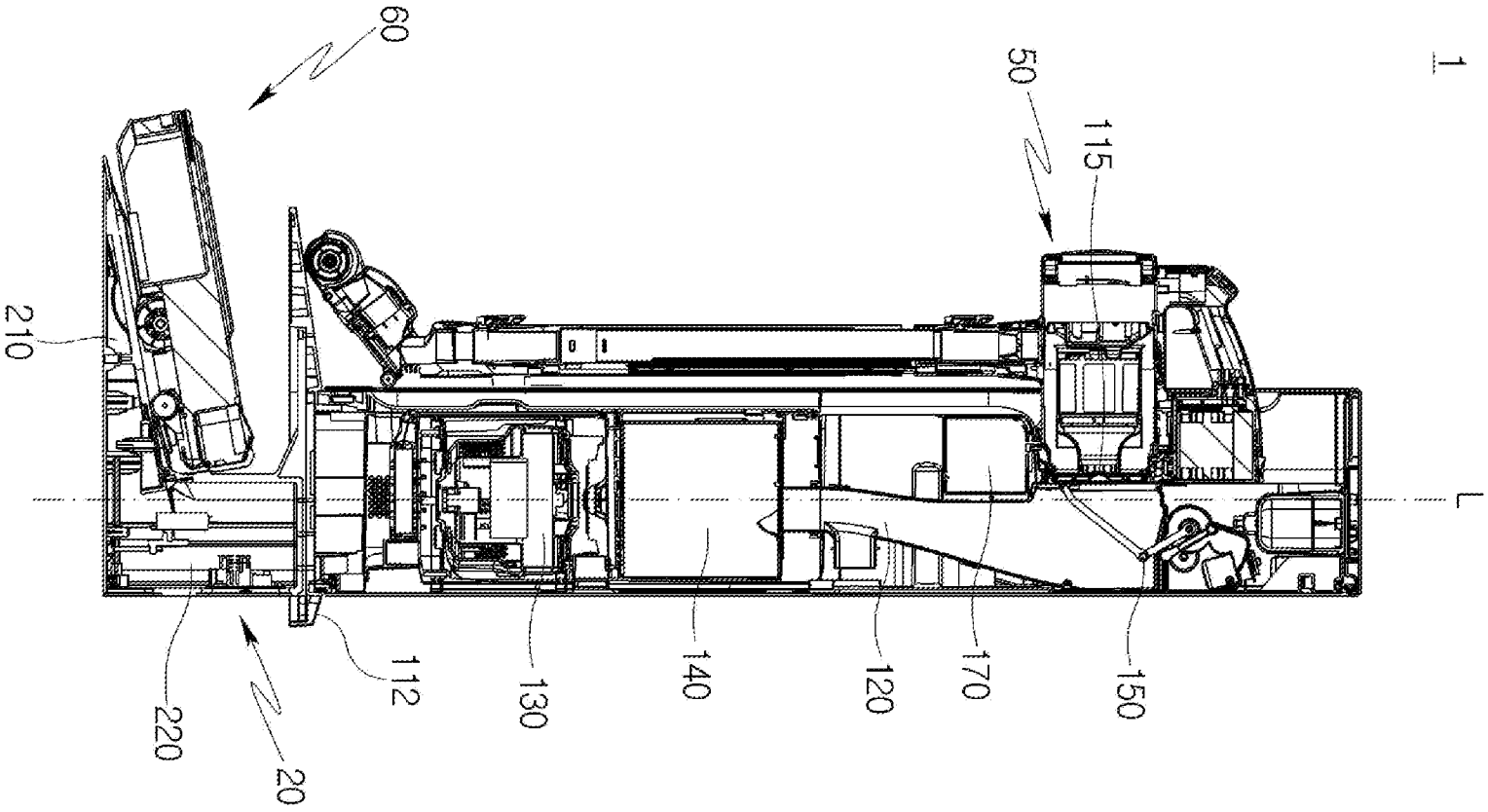

[FIG. 2]
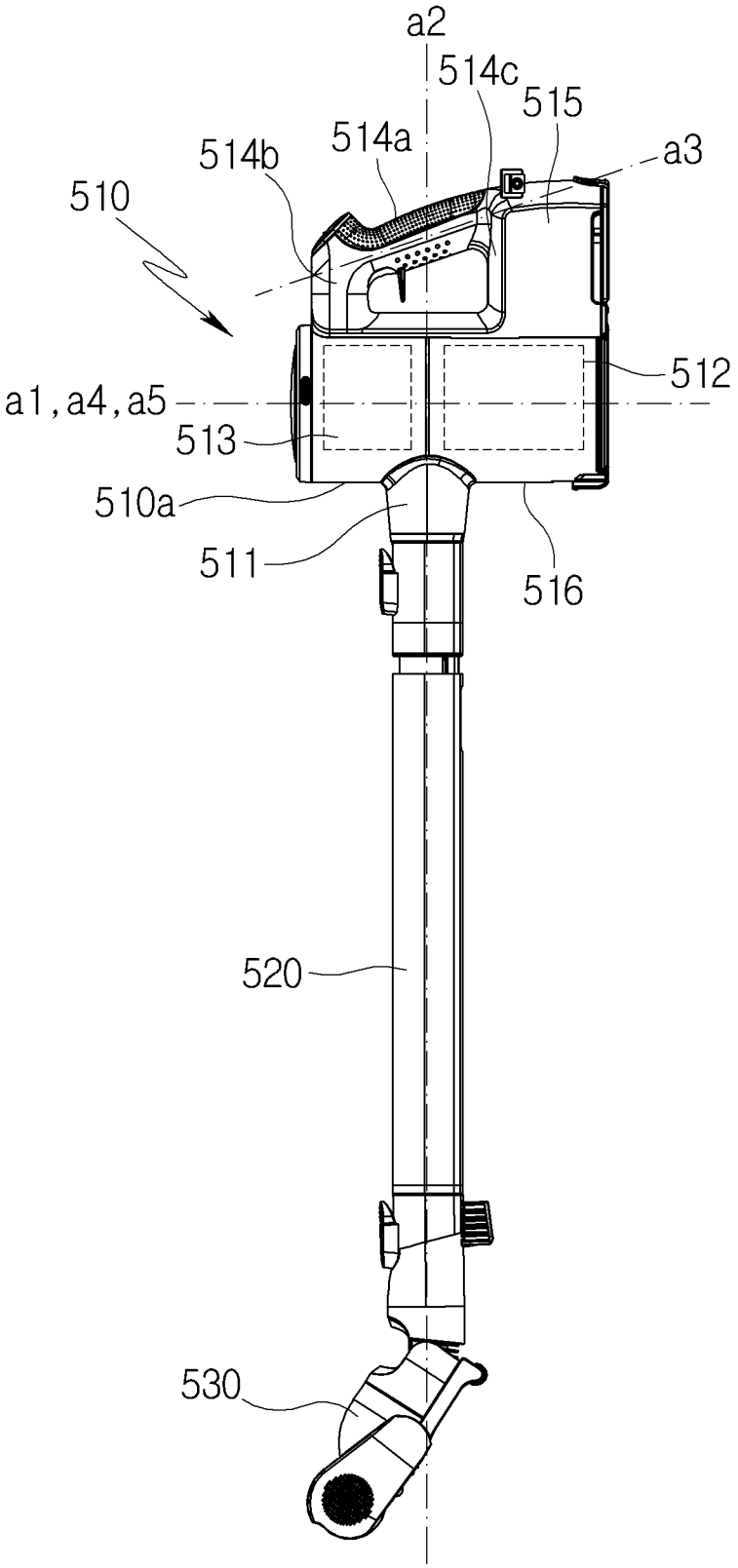

[FIG. 3]
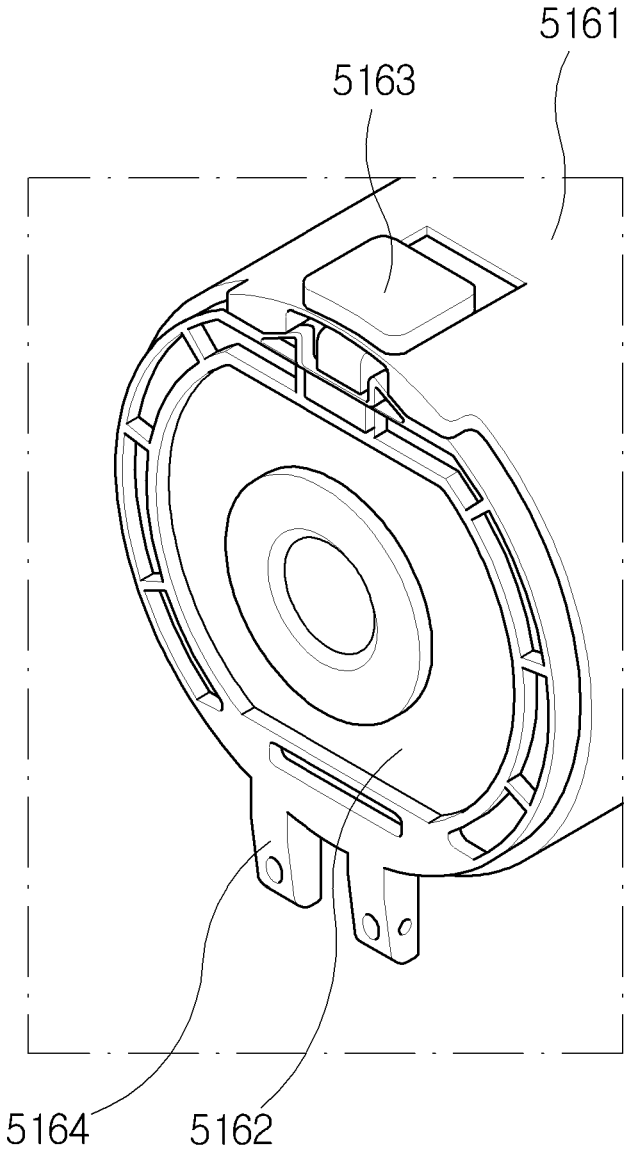

[FIG. 4]
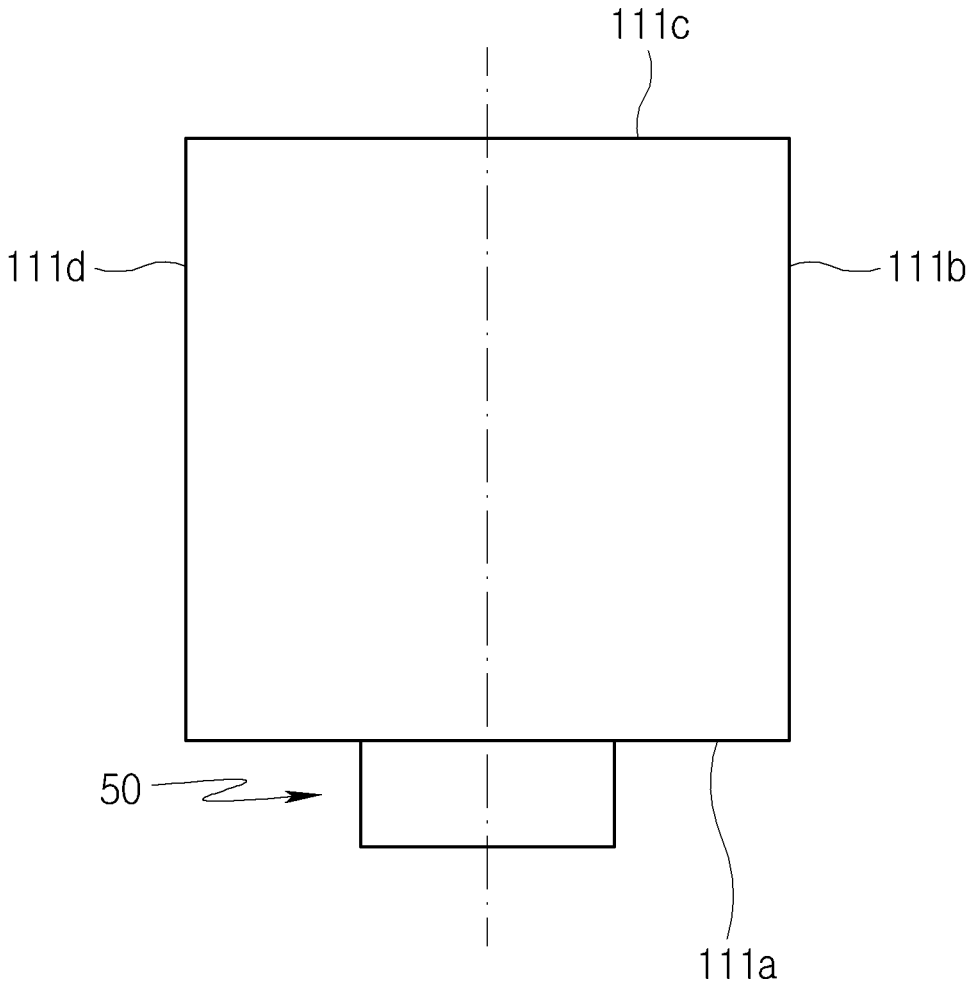

[FIG. 5]
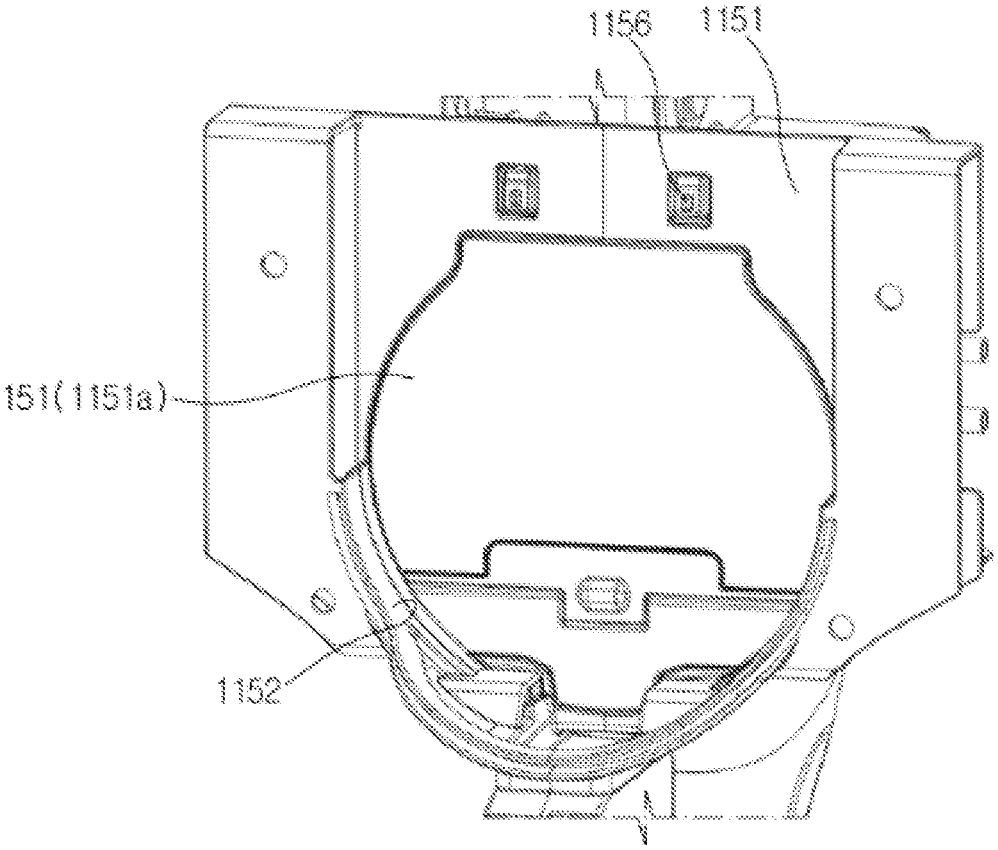

[FIG. 6]
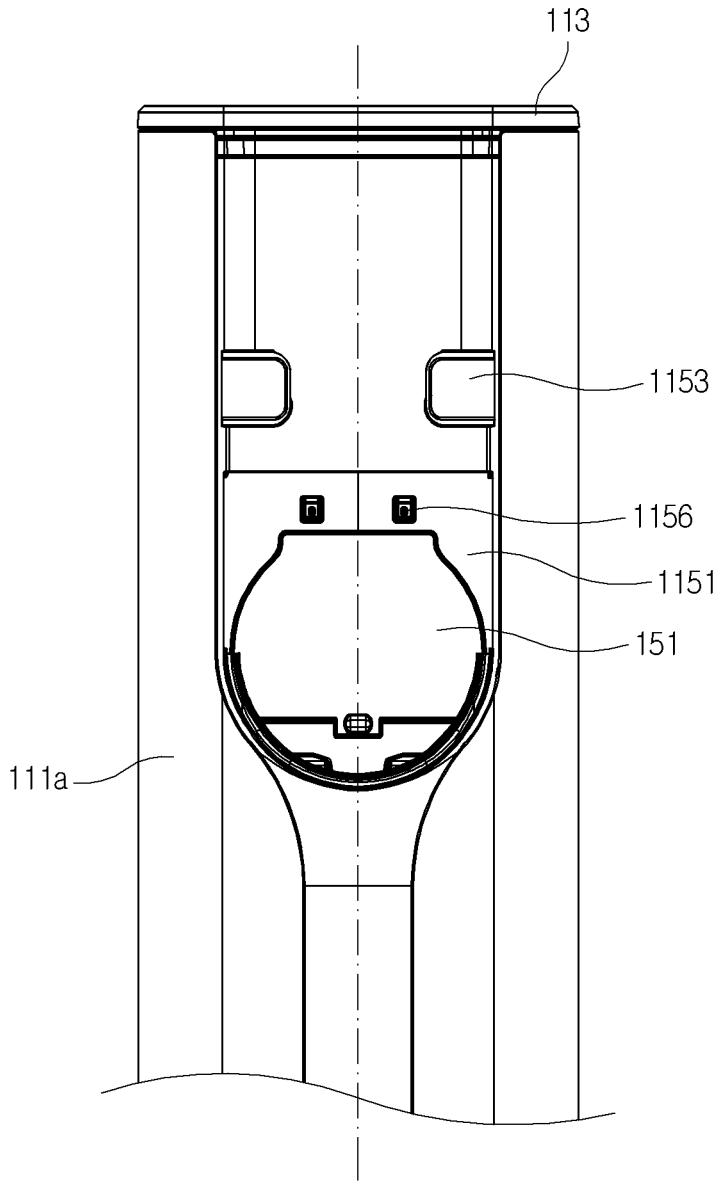

[FIG. 7]
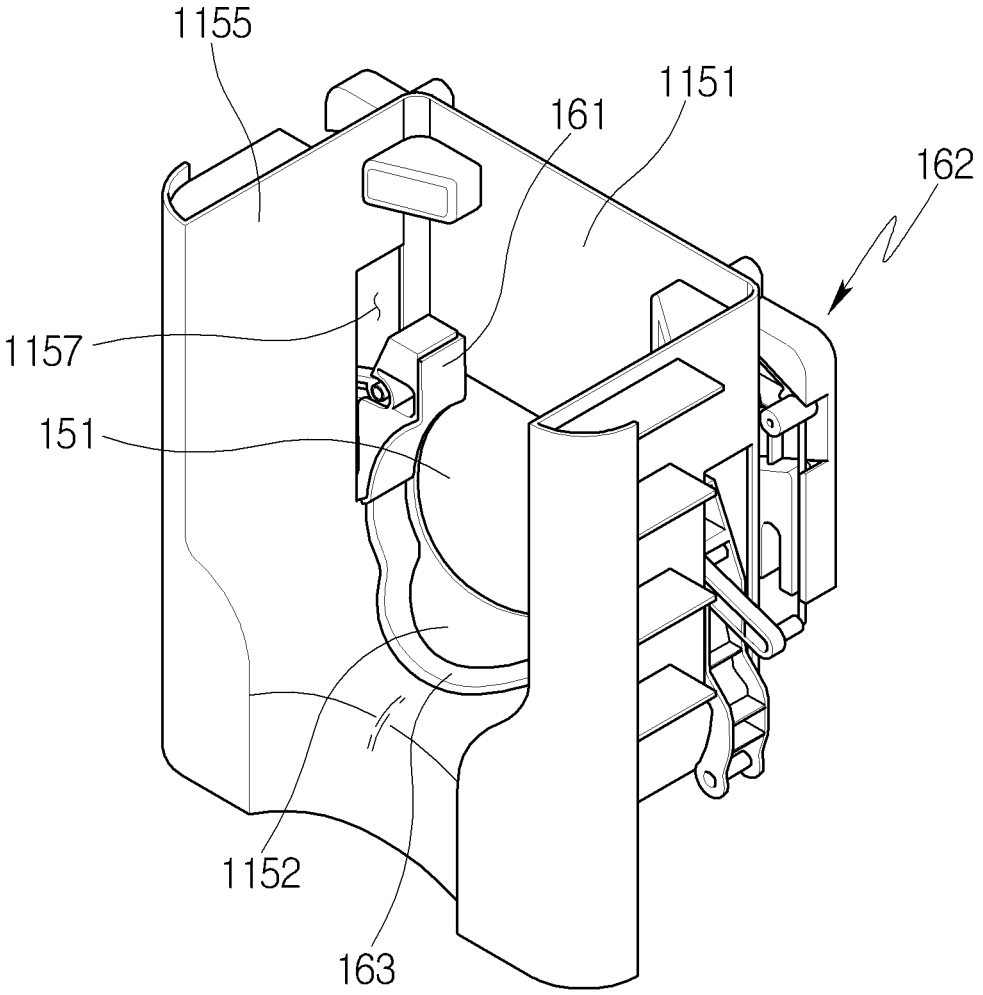

[FIG. 8]
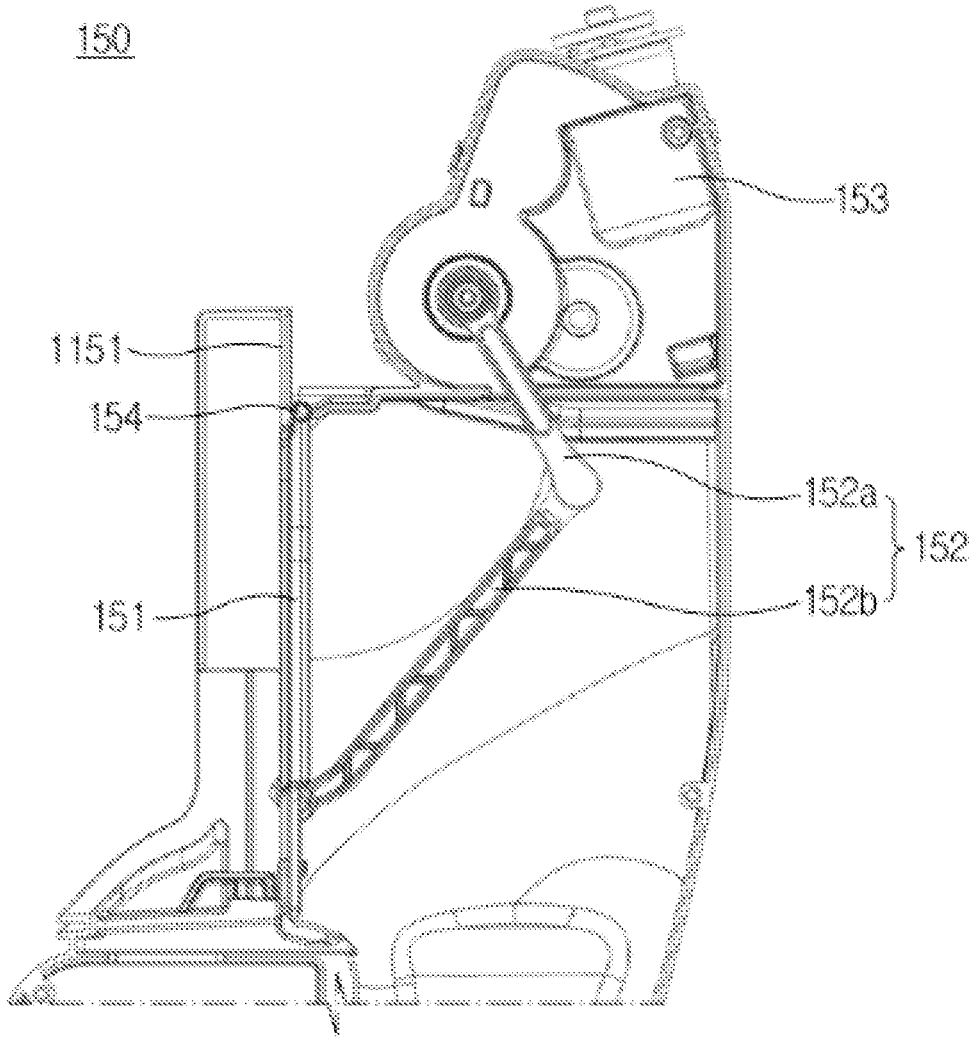

[FIG. 9]
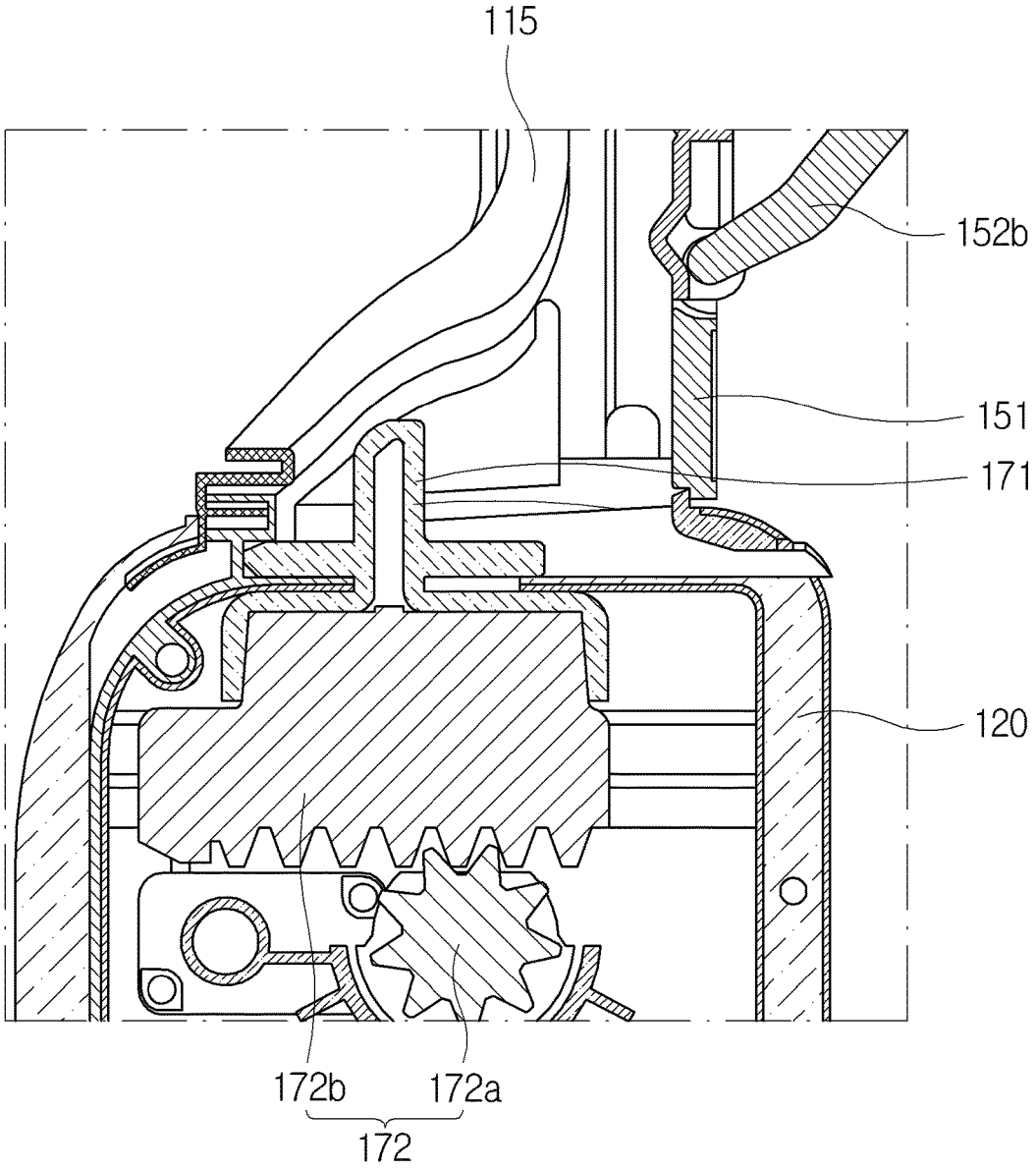

[FIG. 10]
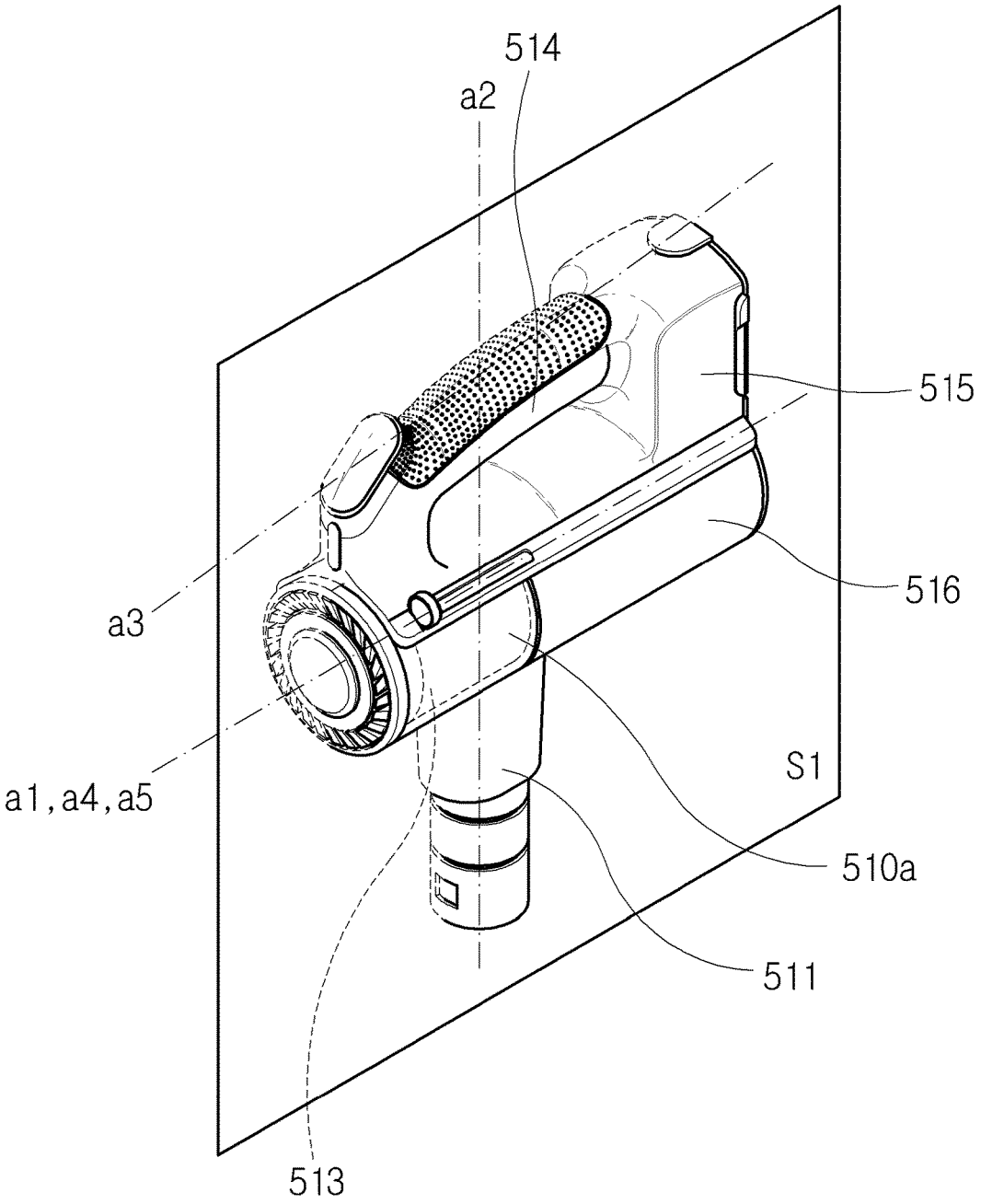

[FIG. 11]
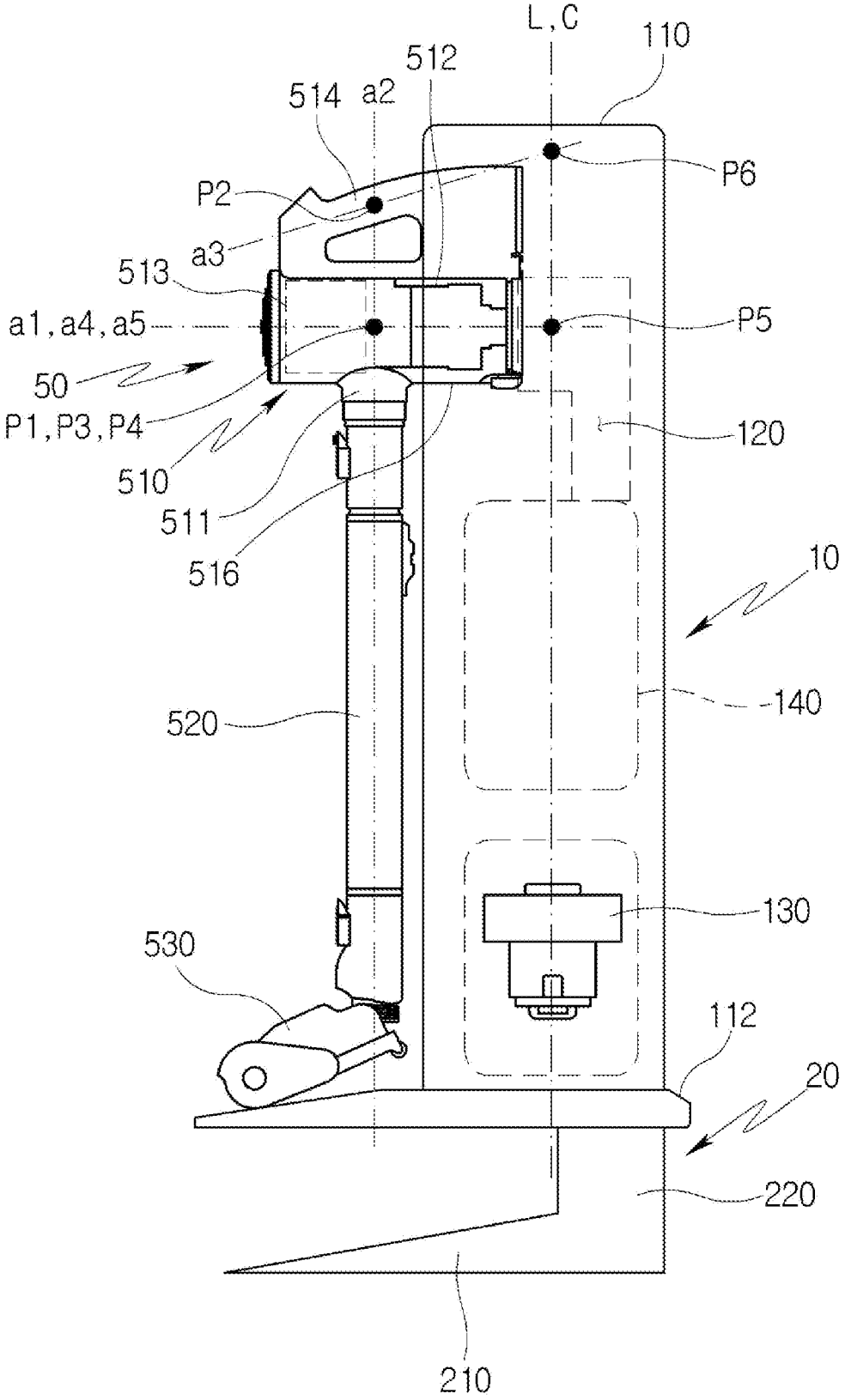

[FIG. 12]
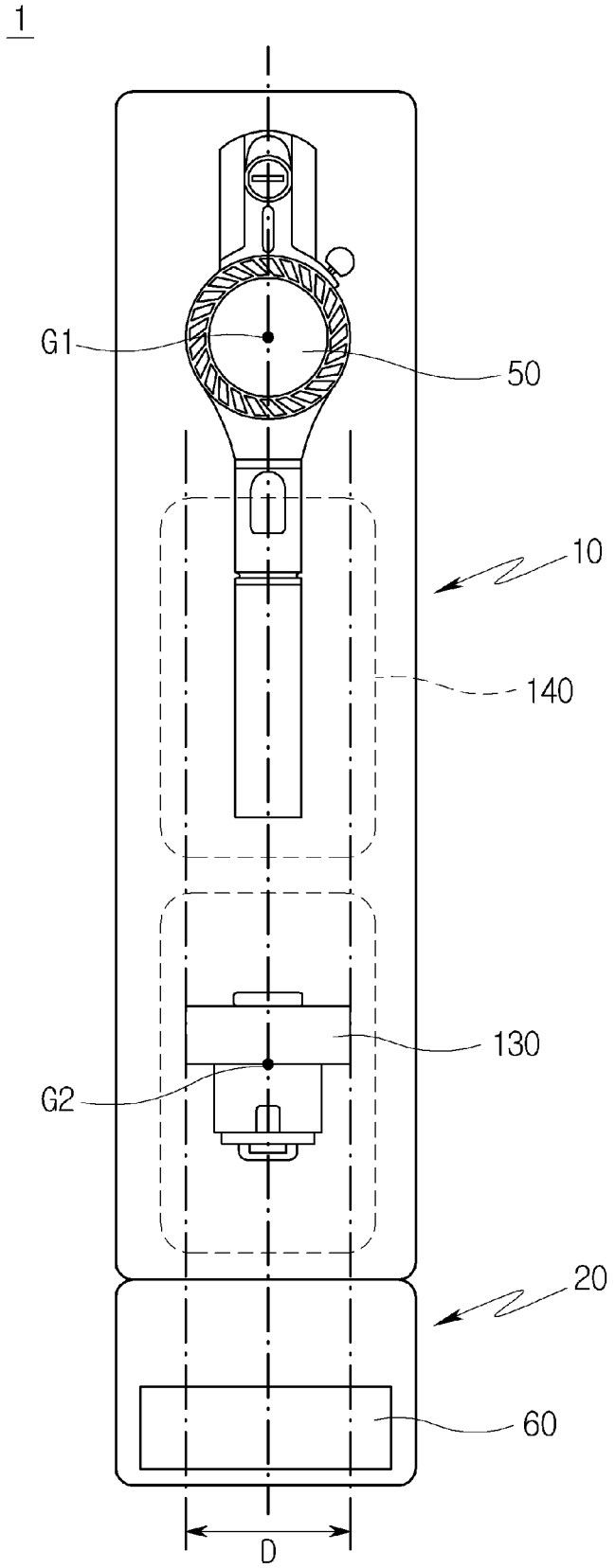

[FIG. 13]
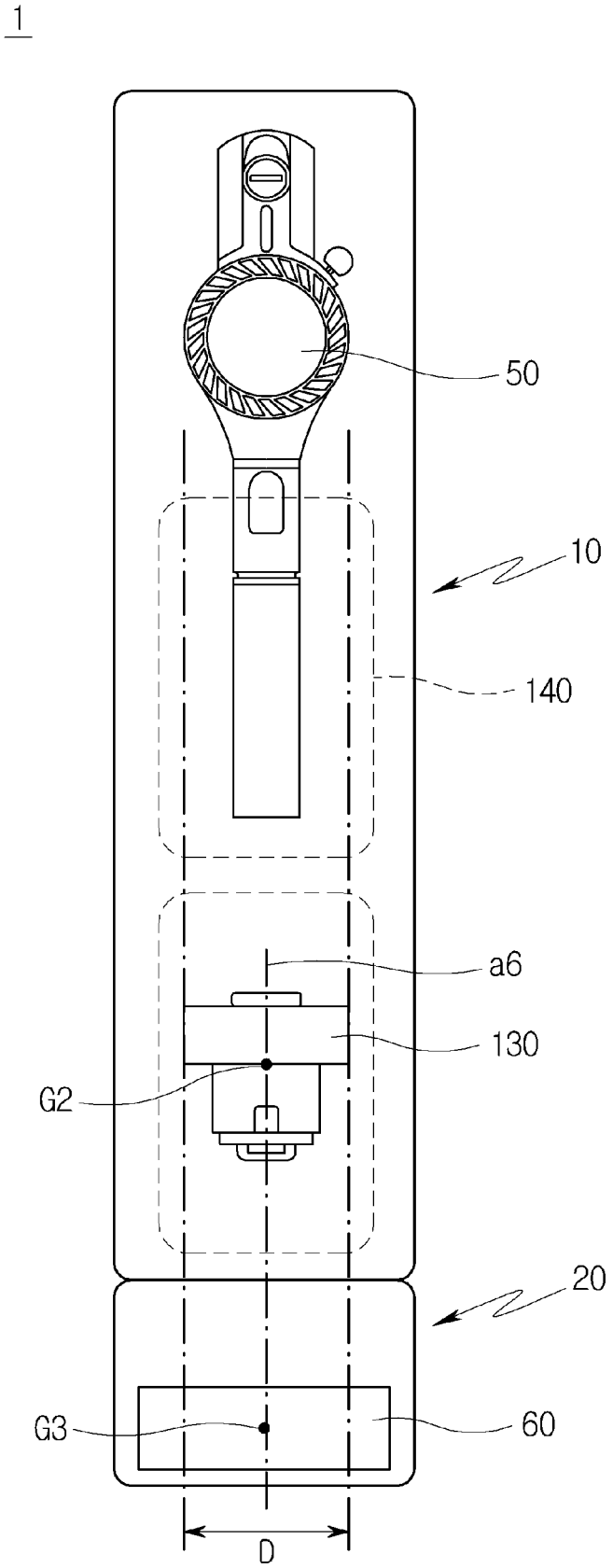

[FIG. 14]
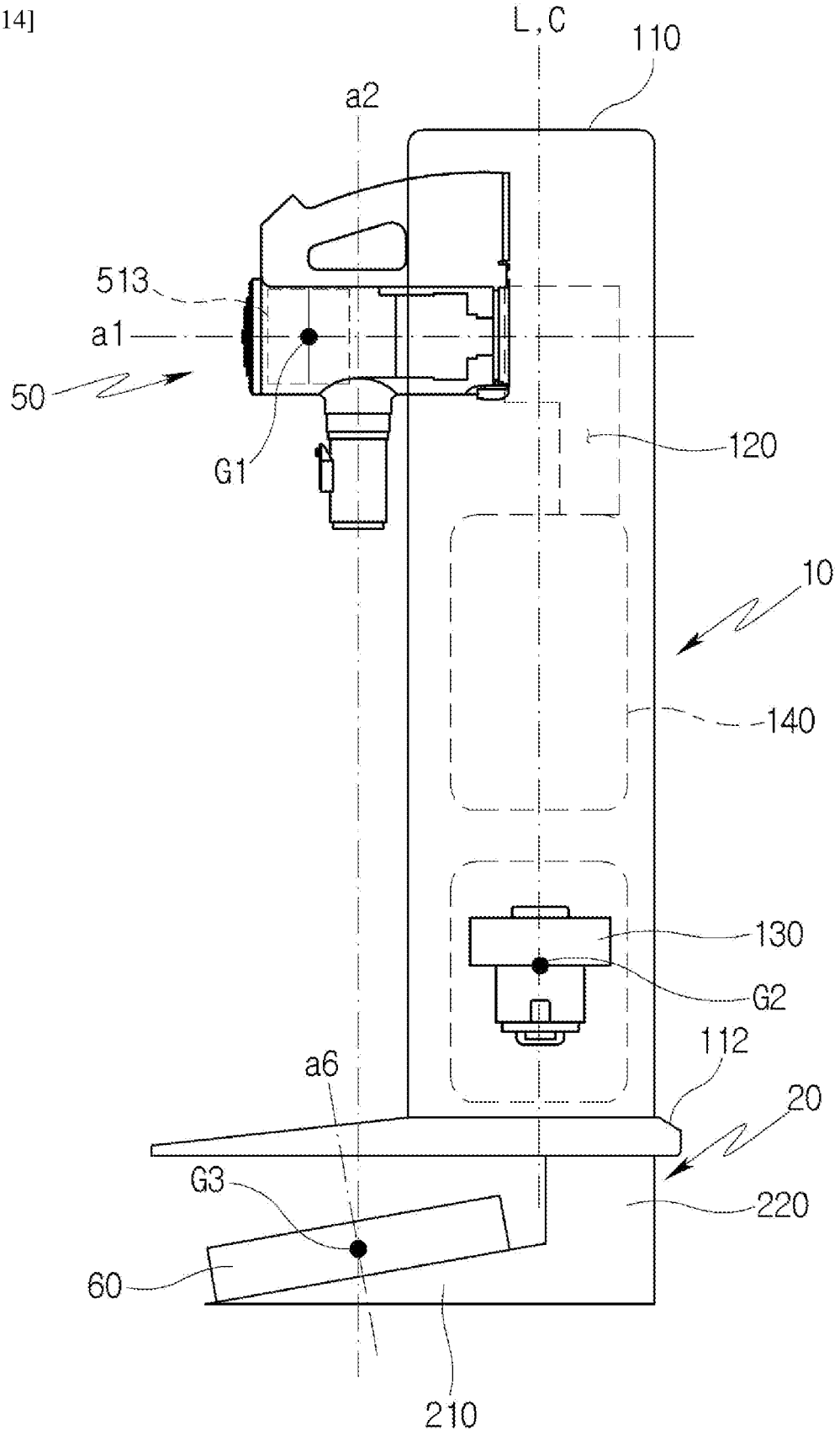

[FIG. 15A]
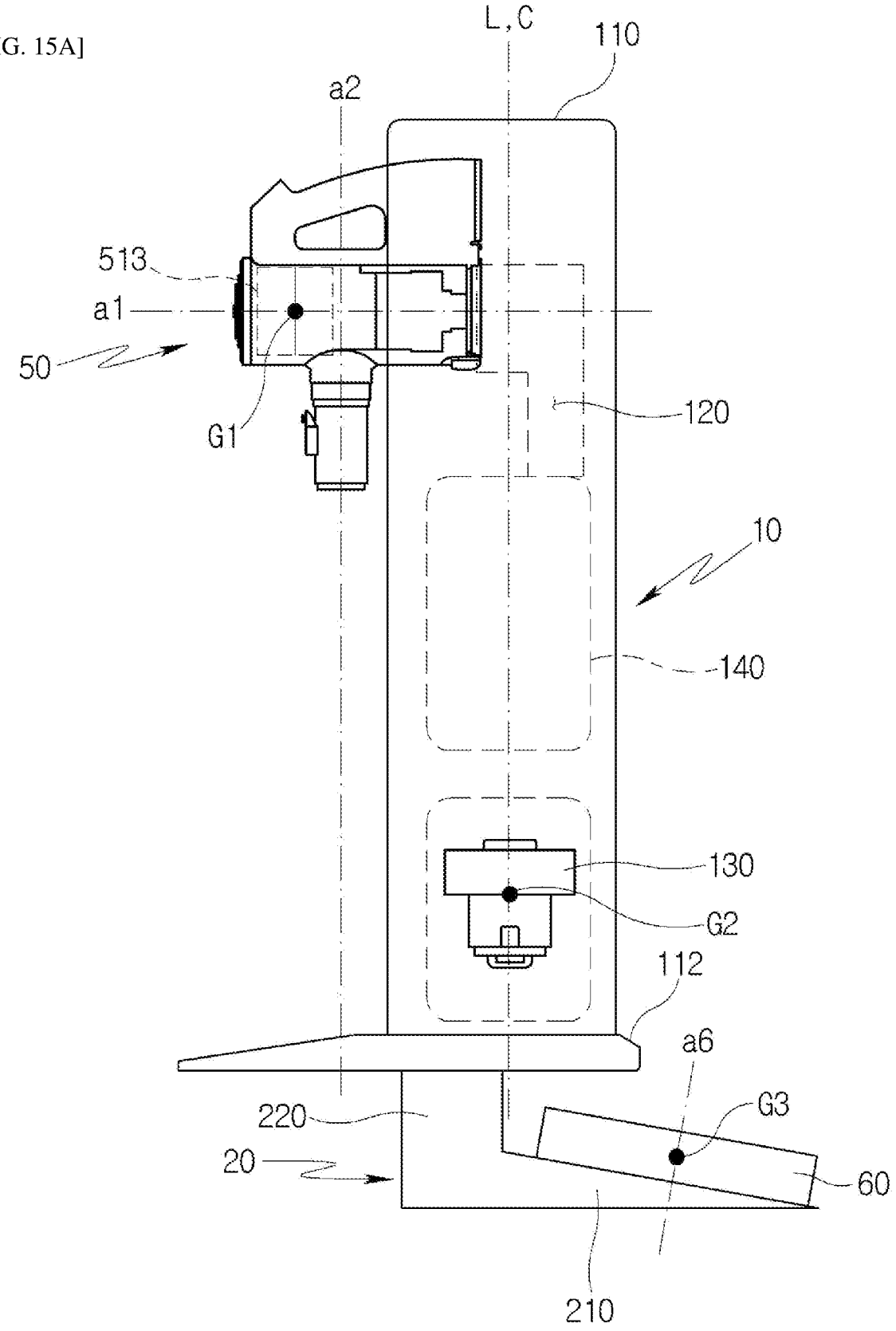

[FIG. 15B]
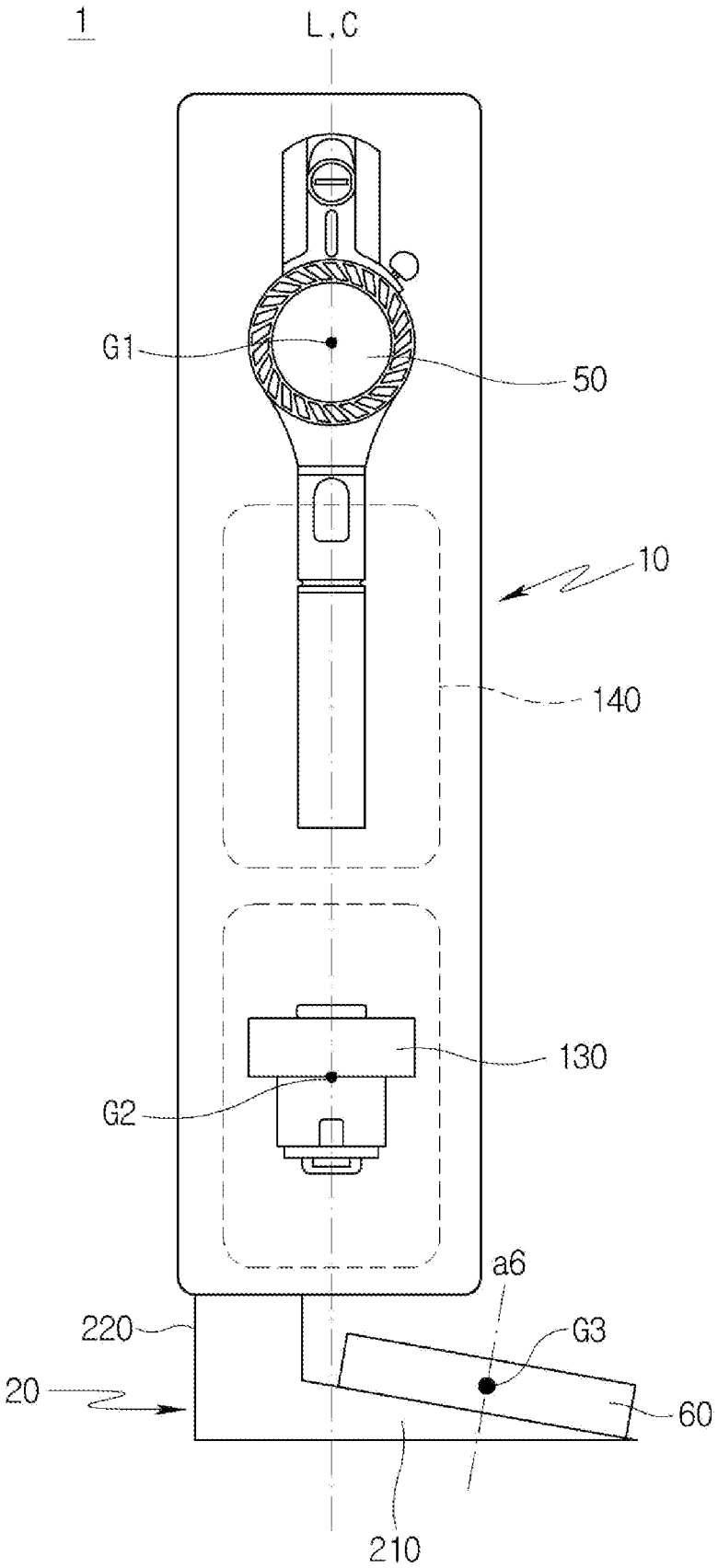

[FIG. 15C]
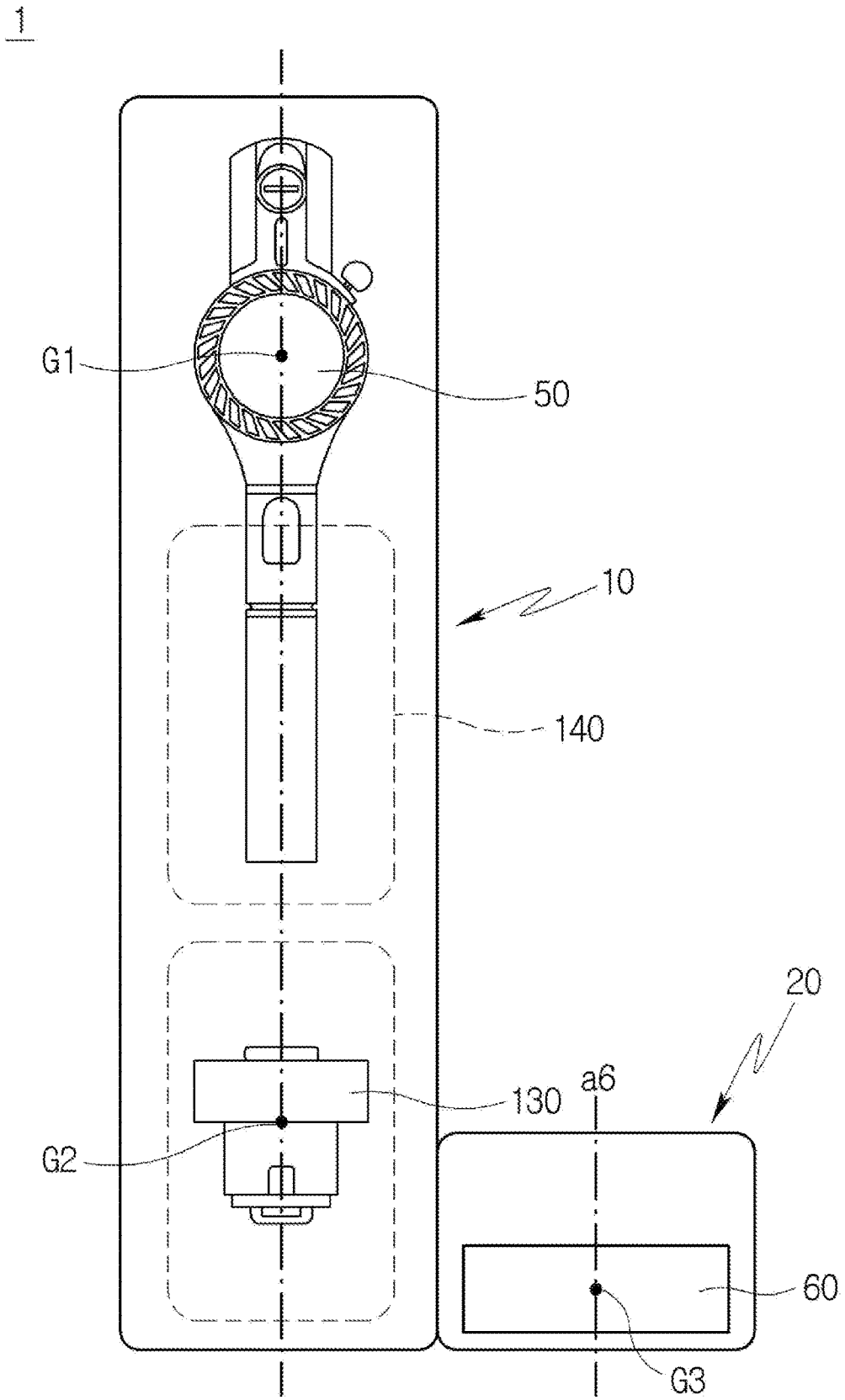

[FIG. 15D]
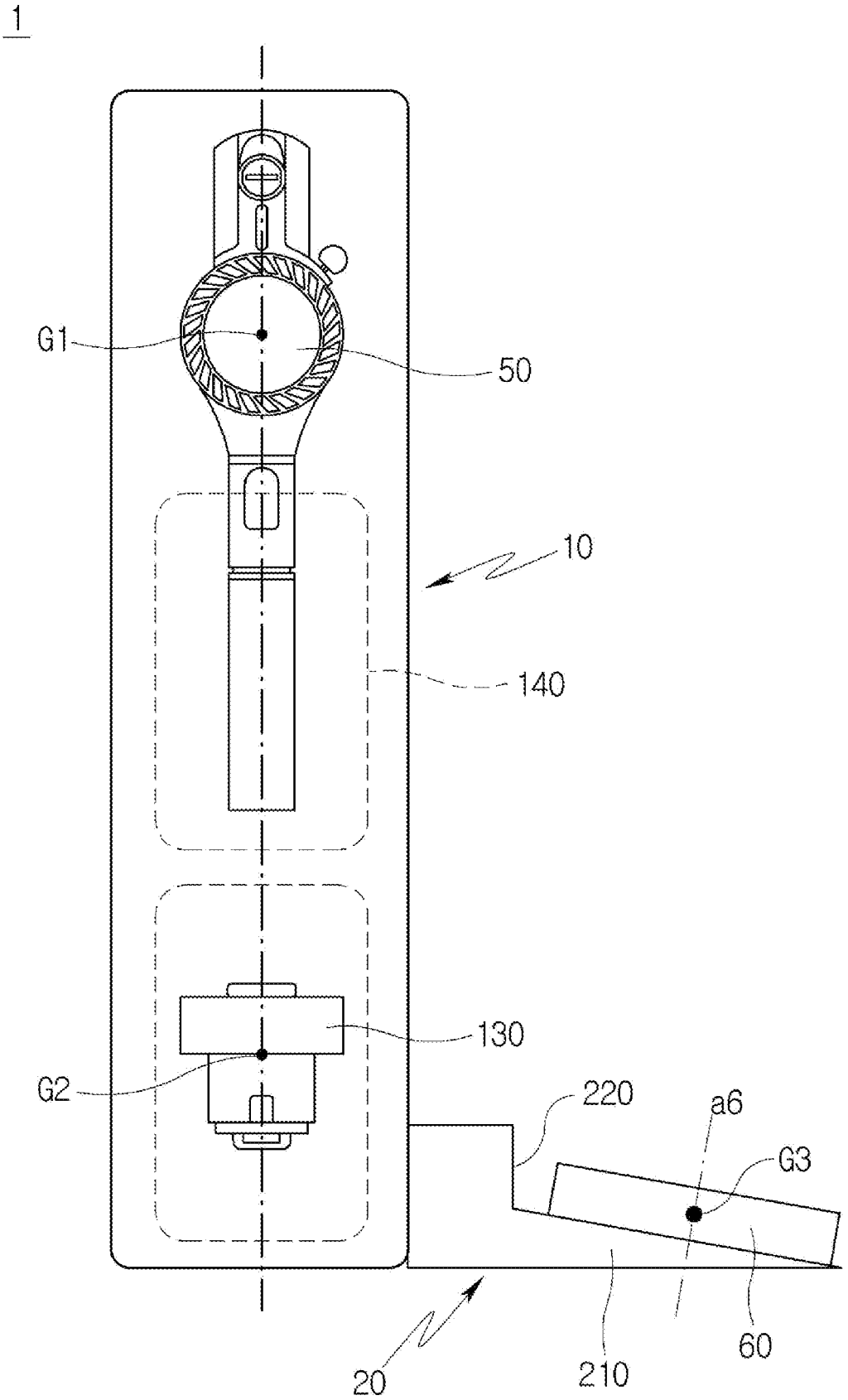

[FIG. 15E]
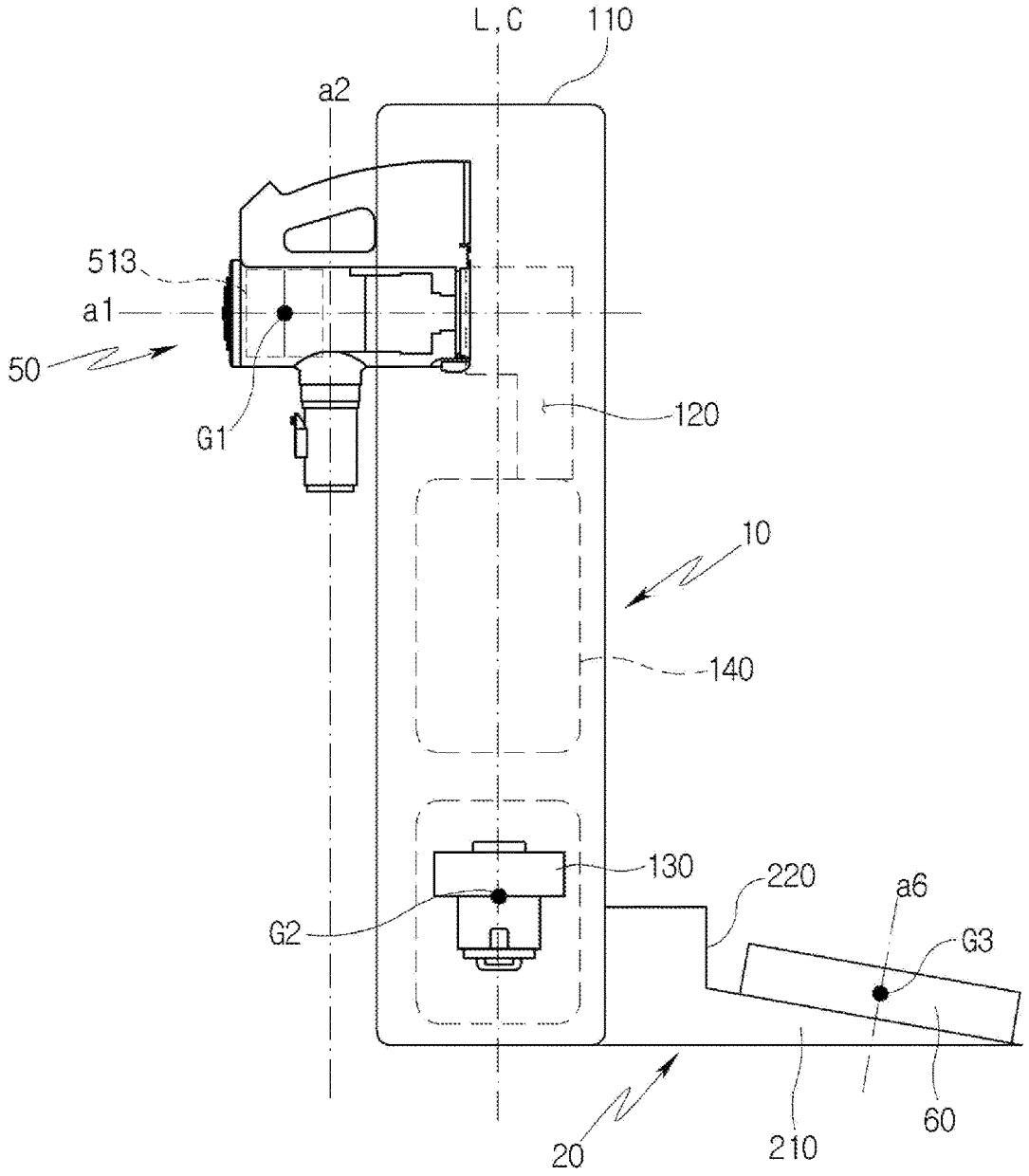

[FIG. 16]
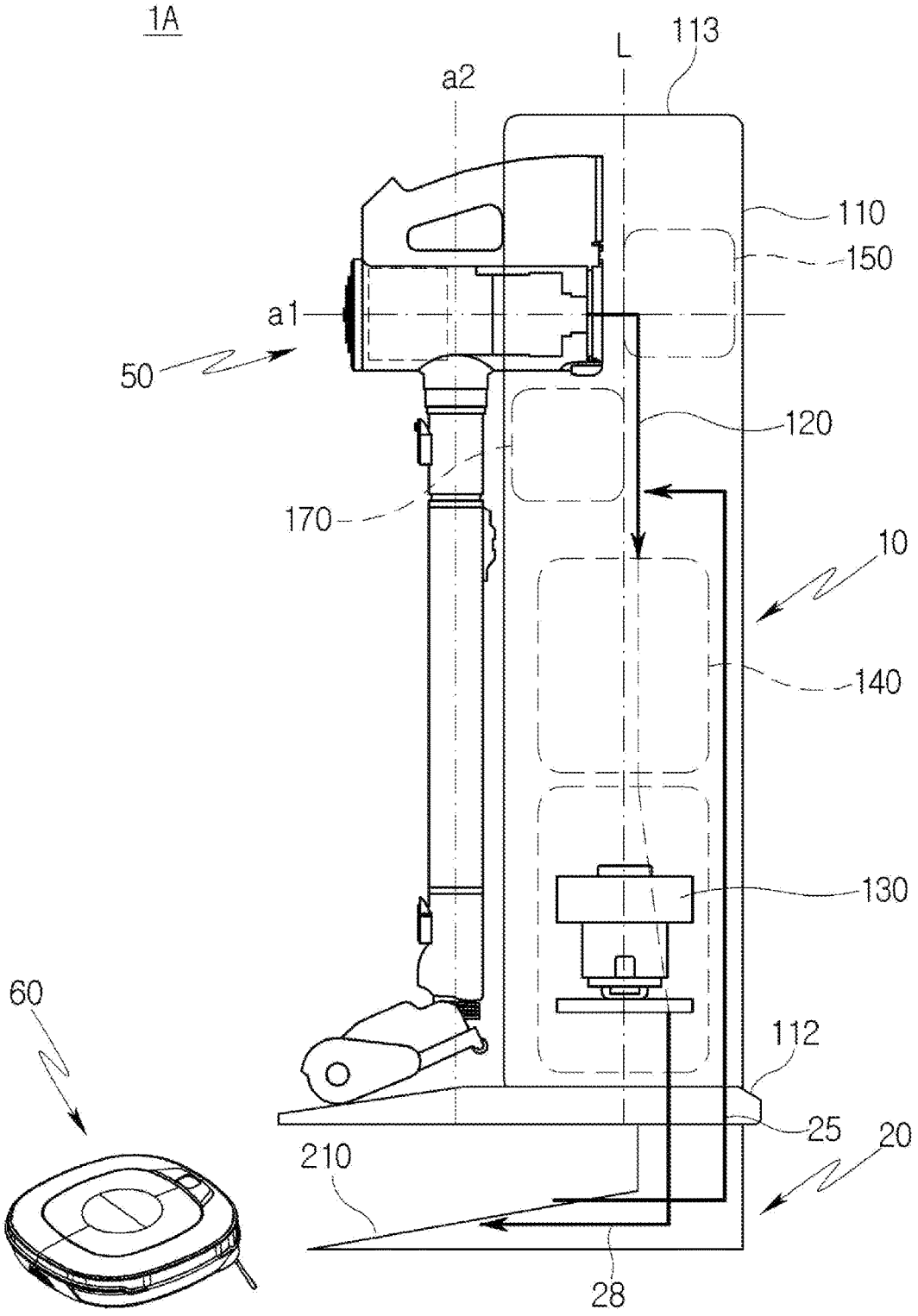

[FIG. 17]
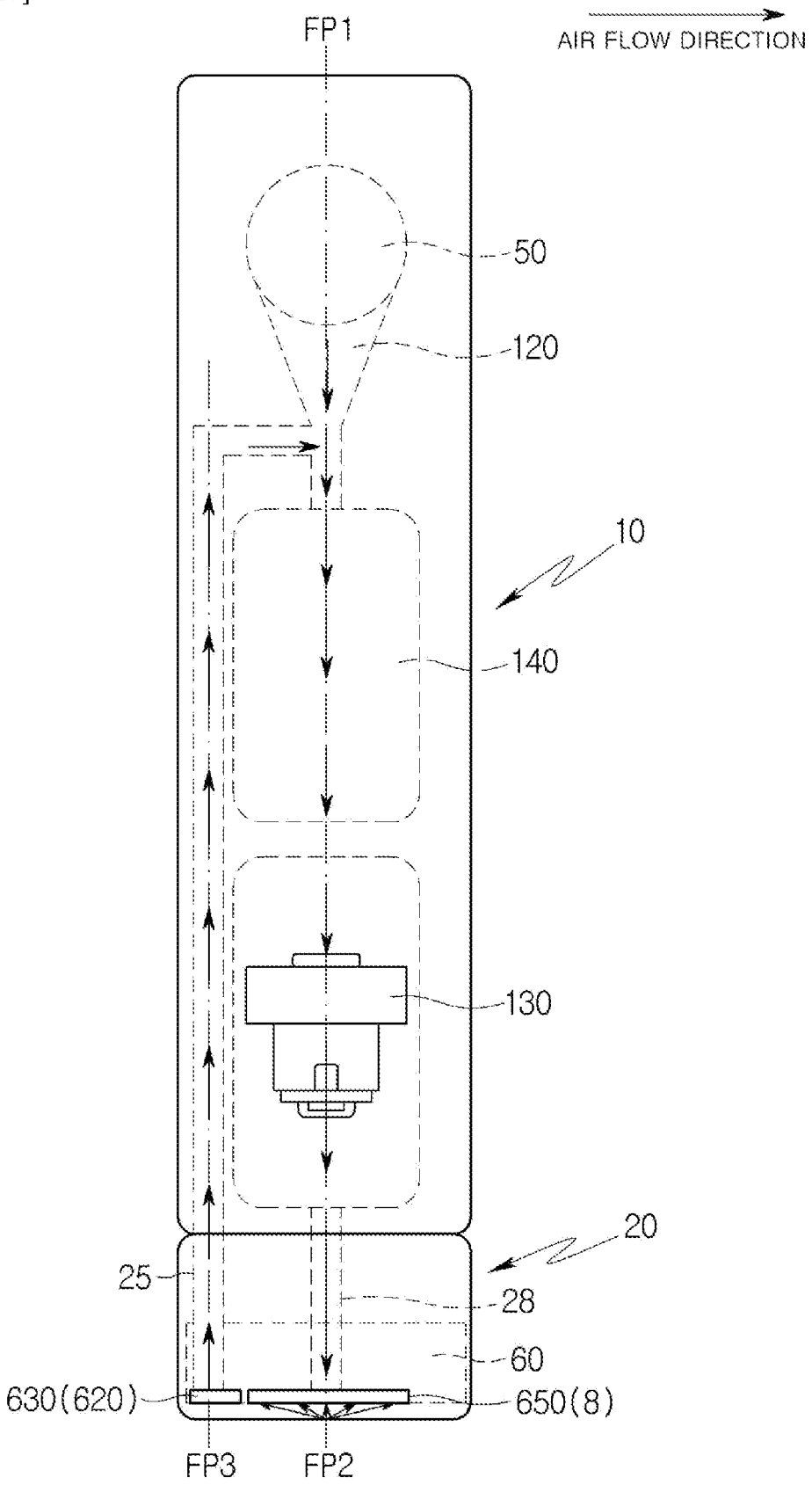

[FIG. 18]
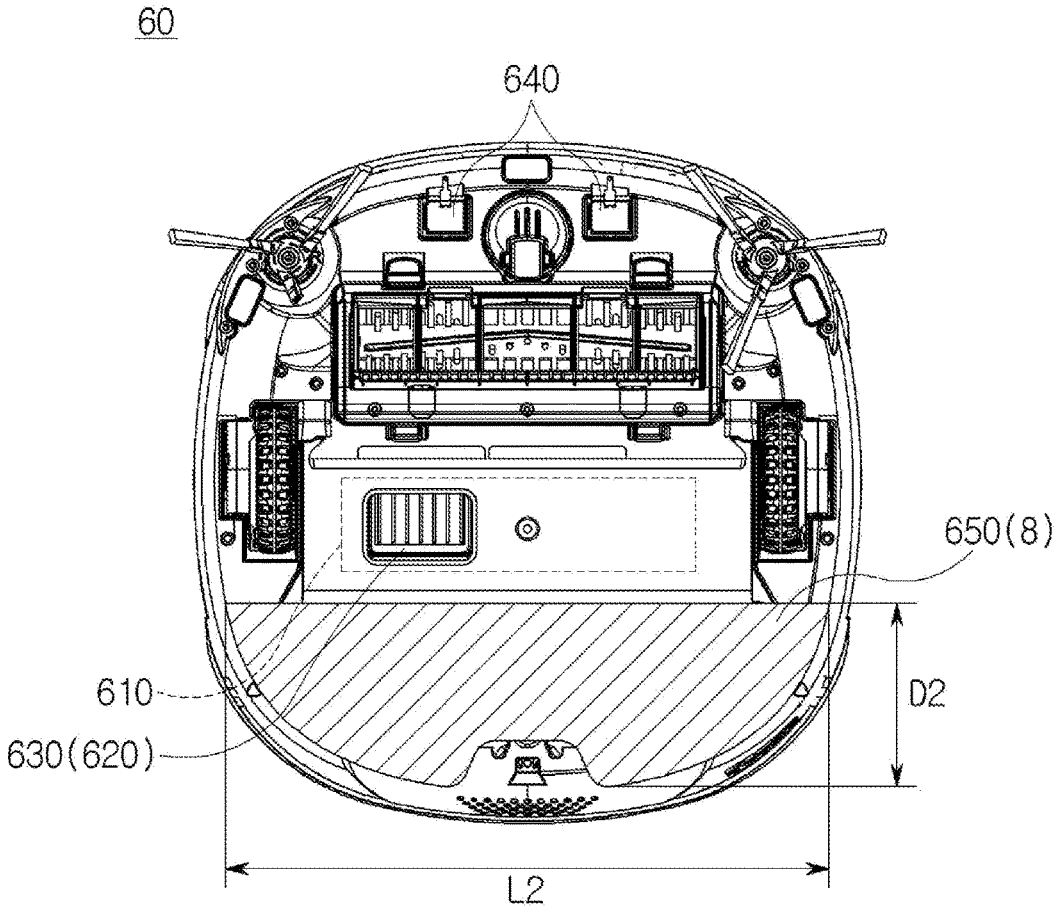

[FIG. 19]
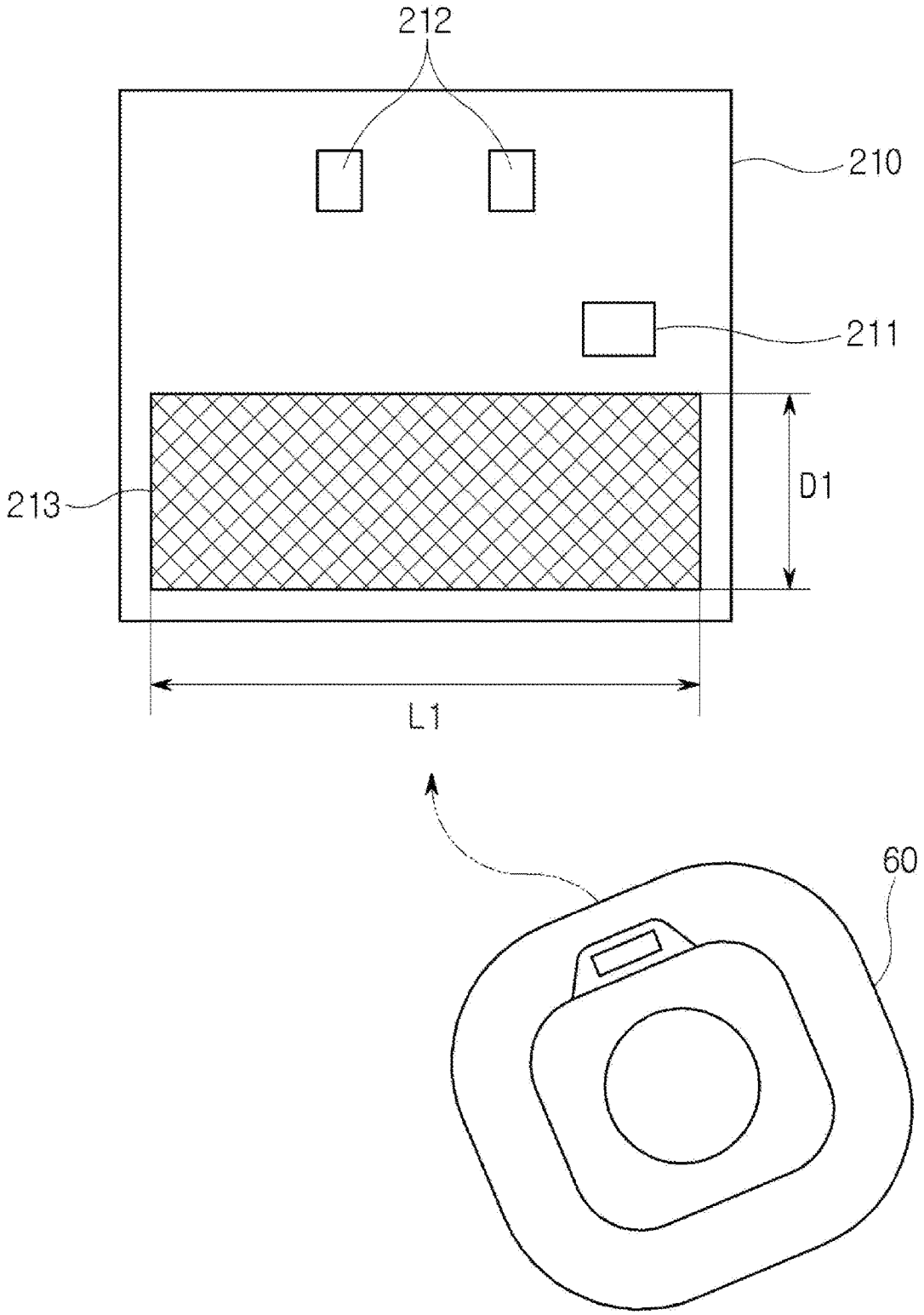

[FIG. 20]
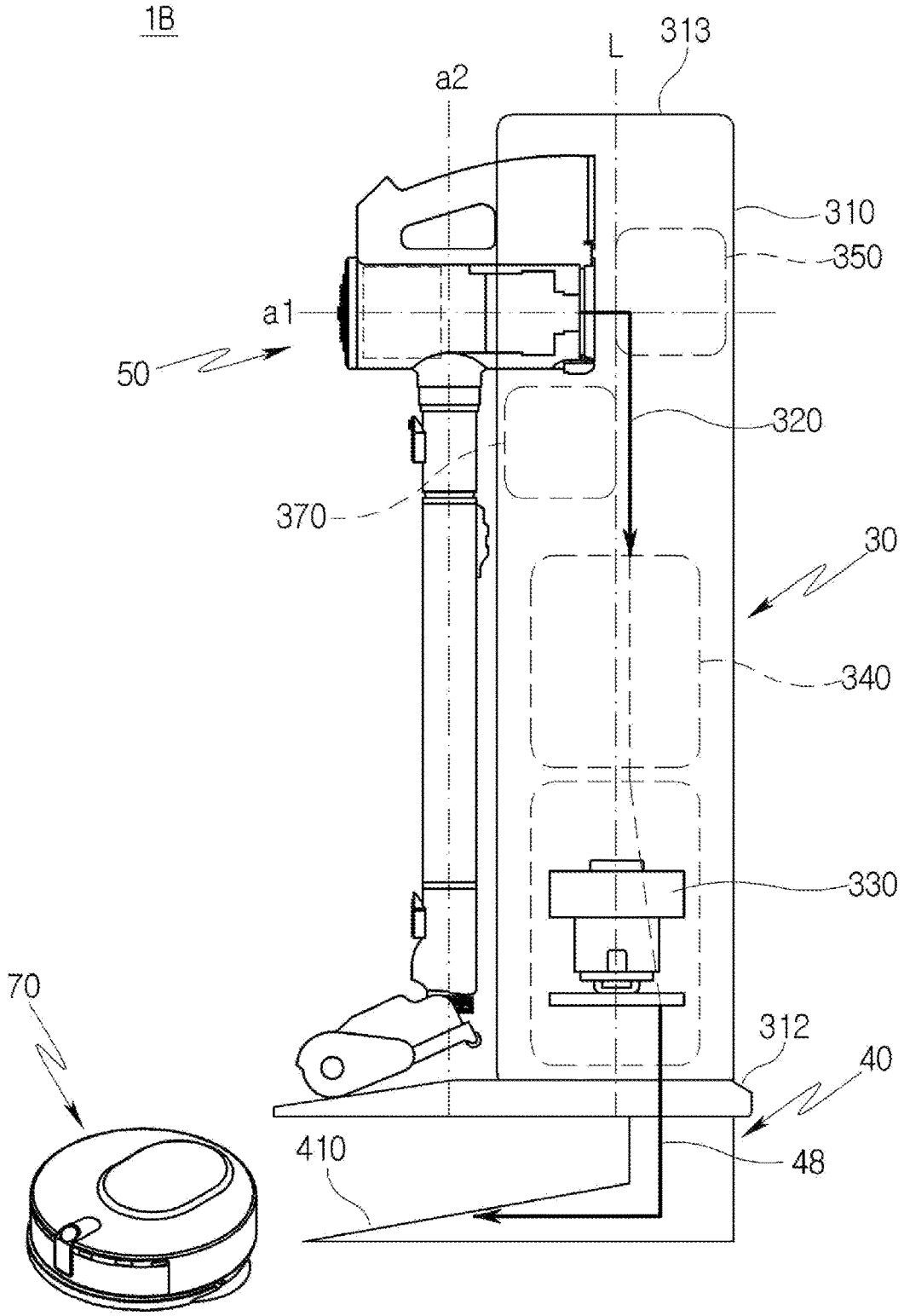

[FIG. 21]
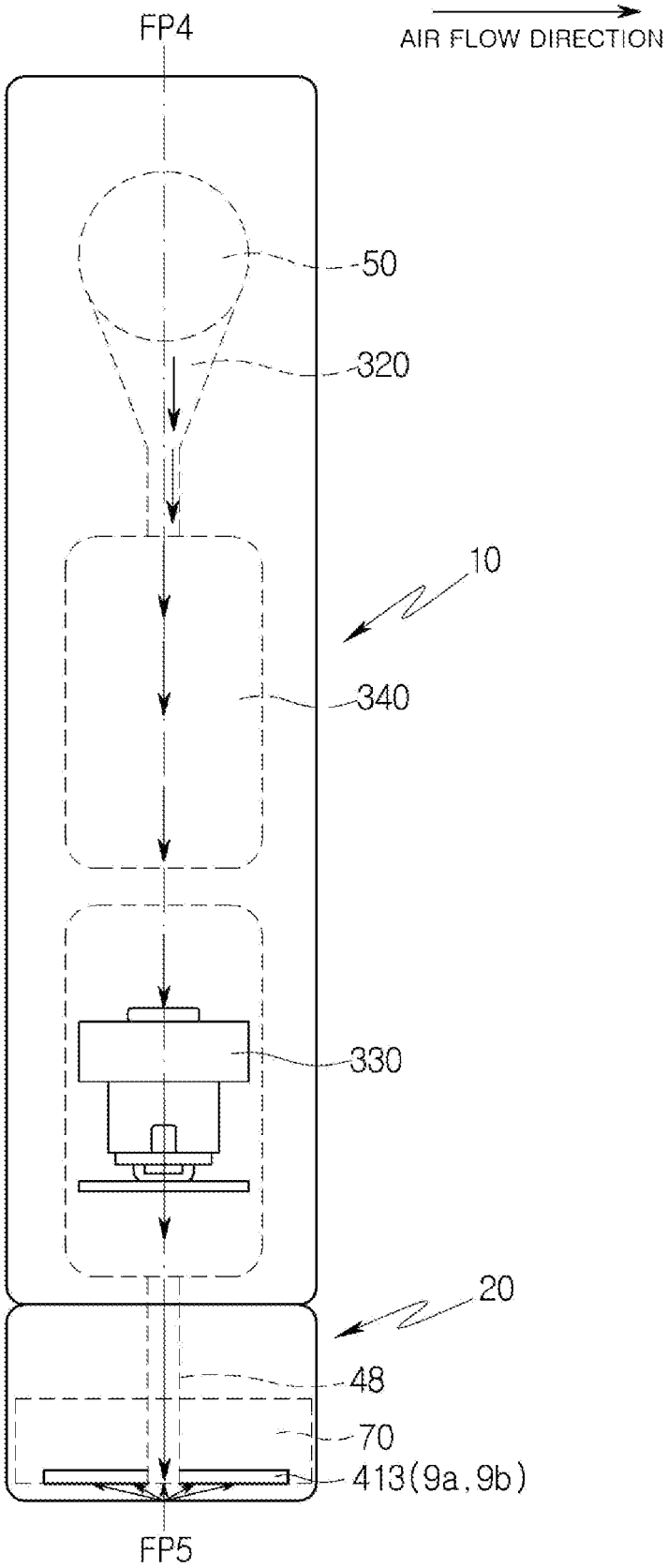

[FIG. 22]
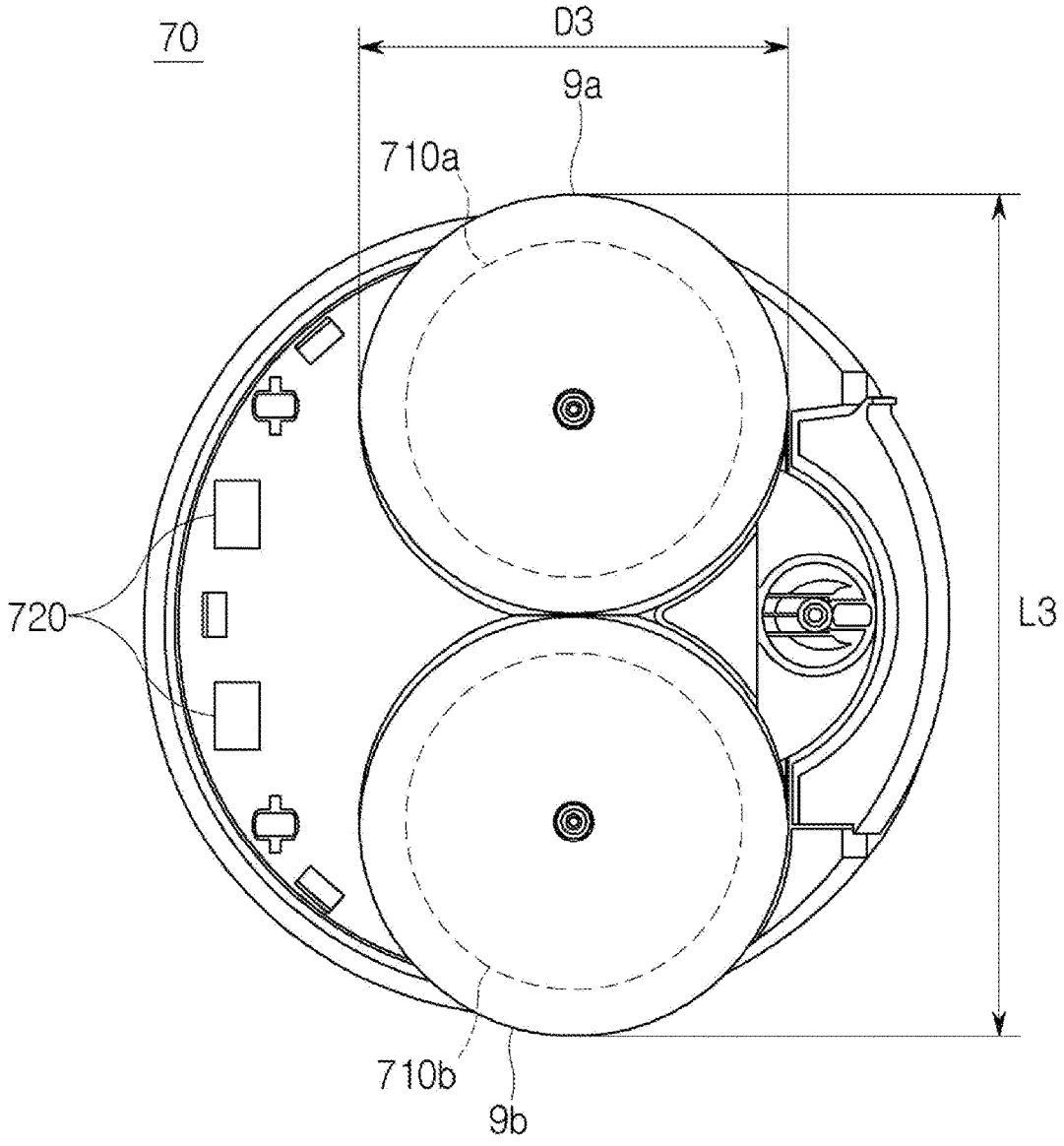

[FIG. 23]
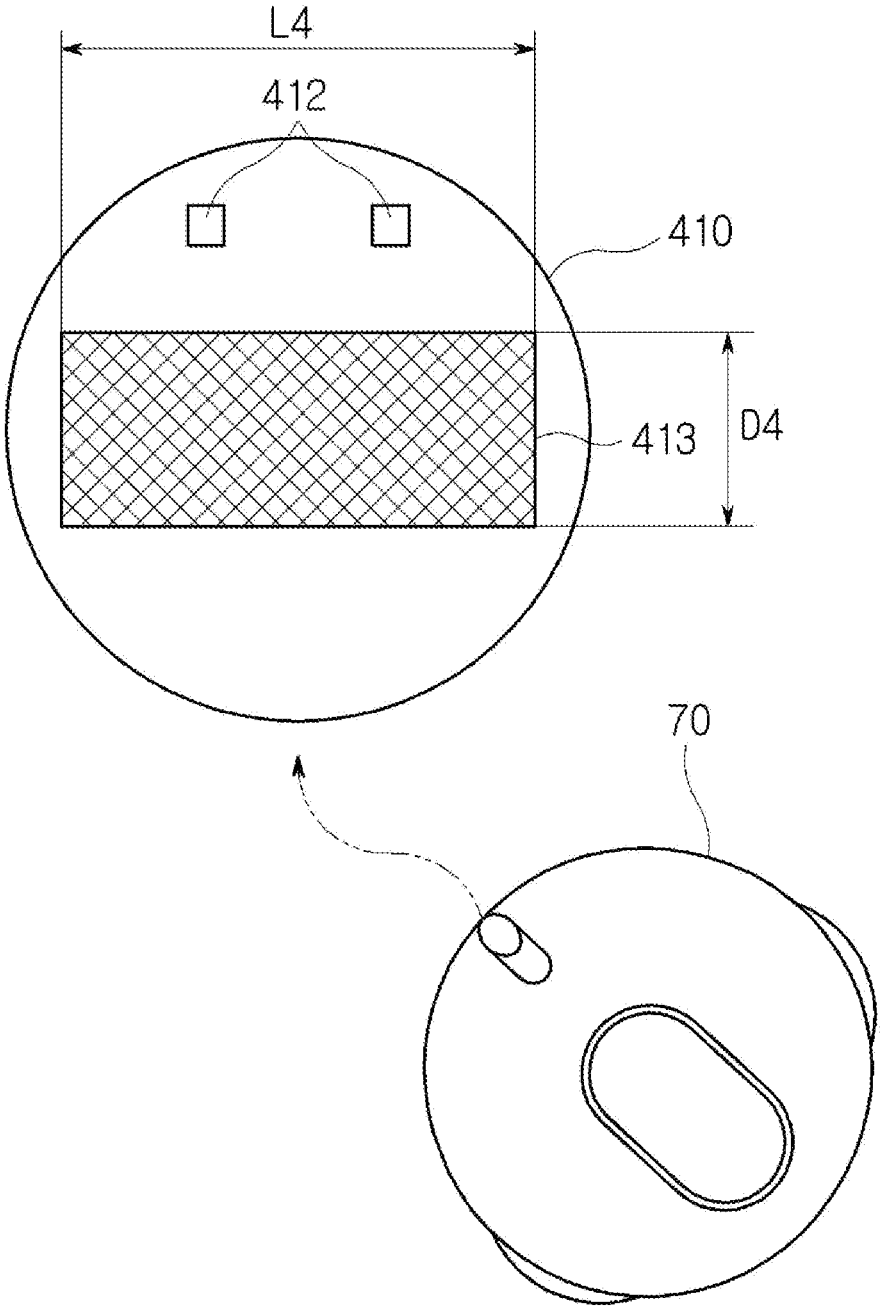

CLEANER SYSTEM

CROSS-REFERENCE TO RELATED PATENT APPLICATIONS

This application is a U.S. National Stage Application under 35 U.S.C. § 371 of PCT Application No. PCT/KR2021/018827, filed Dec. 13, 2021, which claims priority to Korean Patent Application Nos. 10-2020-0176020, filed Dec. 16, 2020 and 10-2021-0171228, filed Dec. 2, 2021, whose entire disclosures are hereby incorporated by reference.

TECHNICAL FIELD

The present disclosure relates to a cleaner system provided to remove dust within a dust bin of a cleaner, and more particularly to a cleaner system to which both a stick cleaner and a robotic cleaner can be coupled.

BACKGROUND ART

In general, a cleaner is a home appliance which sucks small garbage or dust in a way of sucking air by using electricity and fills the garbage or dust in a dust bin included in the cleaner product. The cleaner is usually called a vacuum cleaner.

Such a cleaner can be divided into a manual cleaner which performs cleaning by being moved directly by a user and an automatic cleaner which performs cleaning while travels by itself. The manual cleaner can be divided into a canister vacuum cleaner, an upright vacuum cleaner, a hand vacuum cleaner, and a stick vacuum cleaner, etc., in accordance with the shape thereof.

In the past, the canister vacuum cleaner has been used widely as a household cleaner. However, recently, the hand vacuum cleaner and the stick vacuum cleaner, which include a dust bin formed integrally with the body of the cleaner and provides improved convenience for use, tend to be used a lot.

In the case of the canister vacuum cleaner, the body and the suction port thereof are connected by a rubber hose or pipe. In some cases, the cleaner can be used in such a way that a brush is inserted into the suction port.

The hand vacuum cleaner has the maximized portability, and thus, has a light weight and a short length. Therefore, the cleaning area of the cleaner may be limited. Accordingly, the hand vacuum cleaner is used to clean a local place such as on a desk or sofa, the inside of a vehicle.

The stick vacuum cleaner allows a user to use itself with a standing posture, and thus, the cleaning can be made without bending his/her waist forward. Therefore, it is advantageous for cleaning while moving over a wide area. While the handy vacuum cleaner cleans a narrow space, the stick vacuum cleaner is able to clean a wider space than the narrow space and to clean a high place out of reach. Recently, the stick vacuum cleaner is provided in the form of a module, so that the type of the cleaner is actively changed according to various objects.

Also, recently, a robot vacuum cleaner that performs cleaning by itself without a user's operation is generally being used. The robot vacuum cleaner sucks foreign substances such as dust, etc., on the floor while traveling by itself in an area to be cleaned, thereby automatically cleaning the area to be cleaned.

However, in the conventional stick cleaner and the robotic cleaner, since the dust bin that stores the collected dust has a small capacity, it is inconvenient for a user to empty the dust bin every time.

In this regard, Korean Patent Application No. 10-2020-0074001 as a prior art document discloses the treatment of dust collected by a stick cleaner.

The patent application No. 10-2020-0074001 discloses a cleaning device which includes a vacuum cleaner including a dust collection container in which foreign substances are collected and includes a docking station connected to the dust collection container so as to remove the foreign substances collected in the dust collection container. In addition, in the cleaning device, the dust collection container is docked to the docking station, and the docking station is configured to include a suction device for sucking foreign substances and internal air within the dust collection container docked to the docking station. Also, the cleaning device is configured to include a collector for collecting the foreign substances within the docking station.

On the other hand, U.S. Registered Patent Publication No. 10463215 as a prior art document discloses a robot cleaner that process collected dust.

The U.S. Registered Patent Publication No. 10463215 discloses a discharge station which includes a base for receiving a robot cleaner and to which the base that has received the robot cleaner is docked. In addition, the discharge station is configured to include a canister receiving a filter bag and an air mover moving air to the filter bag, so that dust from the robot cleaner is collected.

However, the above-mentioned patents disclose that dust in a dust bin of only any one of the stick cleaner and the robot cleaner is collected. That is, the inventions disclosed in the above-mentioned patents relate to a cleaning device (or dust collecting device or discharge station) which is exclusively used for one type of cleaner, and have a problem that all the dust within the dust bin of the stick cleaner and the dust bin of the robot cleaner cannot be collected.

In addition, it is difficult for even any one of a stick cleaner and robot cleaner with improved user convenience to perform perfect cleaning due to limitations by structural shapes and technical problems. Therefore, it is often that users purchase both the stick cleaner and the robot cleaner from the beginning, or alternatively users purchase any one type of cleaner and then purchase additionally the other type of cleaner.

Therefore, there is a need to develop a system capable of collecting both dust within the dust bin of the stick cleaner and dust within the dust bin of the robot cleaner.

In addition, in a system configured to be coupled to both the stick cleaner and the robot cleaner, the center of gravity of the cleaner system is not biased to one side in a state in which at least one of the stick cleaner and the robot cleaner is coupled, so that the stick cleaner and/or the robot cleaner should be supported stably.

On the other hand, the robot cleaner may be equipped with a module for wet mop cleaning as well as with a suction function, or may be a robot cleaner exclusively used for wet mop, which includes only the module for wet mop cleaning. The robot cleaner which is exclusively used for wet mop or has a wet mop function returns to a charging stand in a state of having the wet mop attached thereto and is charged. If a user forgets to replace the wet mop and leaves the robot cleaner for a long time, the wet mop is not dried to cause odor, or the charging stand is contaminated due to the grow of bacteria in the wet mop.

DISCLOSURE

Technical Problem

The purpose of the present disclosure is to provide a cleaner system to which a first cleaner provided to be held by a user to perform cleaning and a second cleaner provided to perform cleaning while autonomously traveling in an area to be cleaned are coupled so that dust within a dust bin of each of the cleaners is collected.

Another object of the present disclosure is to provide a cleaner system capable of stably maintaining balance when the first cleaner and the second cleaner are coupled.

Further another object of the present disclosure is to provide a cleaner system capable of hygienically managing the second cleaner by preventing the mop attached to the second cleaner from being left in a wet state when the second cleaner which is exclusively used for the wet mop or is for combined use of the wet mop is coupled.

Technical Solution

One embodiment is a cleaner system including: a first cleaner that includes a suction portion which sucks dust-containing air through an extension tube through which air flows, a suction motor which generates a suction force for sucking air along the suction portion, and a dust bin which stores dust separated from the sucked air; a first station that includes a housing which has an inner space and to which the first cleaner is coupled, a first coupling portion which is formed in the housing and to which the dust bin is coupled, and a dust collection motor which is disposed in the inner space and generates a suction force sucking the dust within the dust bin into the housing; a second station that is coupled below the first station and includes a second coupling portion to which a second cleaner climbs; and an imaginary plane that includes an extension tube through-line passing through the extension tube in a longitudinal direction and an imaginary suction motor axial line obtained by extending a rotational axis of the suction motor. The second cleaner is a cleaner that autonomously travels in an area to be cleaned. In a state where the first cleaner is coupled to the first coupling portion and the second cleaner is coupled to the second coupling portion, the suction motor, the dust collection motor, and the second cleaner are arranged in the order listed from the top along a long axis of the housing.

Here, the first cleaner may further include a handle having a grip portion that is disposed in an opposite direction to the suction portion such that a user grips the first cleaner. The plane may include an imaginary grip portion through-line that is formed in a longitudinal direction of the grip portion and passes through an inside of the grip portion.

Also, the plane may pass through at least a portion of the first station in the state in which the first cleaner is coupled to the first station, and the extension tube through-line may cross the suction motor axial line.

Also, the plane may pass through at least a portion of the dust collection motor in the state in which the first cleaner is coupled to the first station.

Also, the plane may include an imaginary dust collection motor axial line obtained by extending a rotational axis of the dust collection motor.

Meanwhile, the cleaner system may further include an imaginary second cleaner centerline which passes through a center of gravity of the second cleaner and is orthogonal to a bottom surface of the second cleaner. When the second cleaner is coupled to the second station, the second cleaner centerline may be disposed within a width of the dust collection motor as the first station is viewed from the front.

Also, a center of gravity of the second cleaner may be disposed behind a center of gravity of the suction motor in the state where the first cleaner is coupled to the first station and the second cleaner is coupled to the second station.

Also, a center of gravity of the second cleaner may be disposed between a center of gravity of the suction motor and a center of gravity of the dust collection motor in the state where the first cleaner is coupled to the first station and the second cleaner is coupled to the second station.

Another embodiment is a cleaner system including: a first station that includes a housing which has an inner space and to which a first cleaner is coupled and a first cleaner suction flow path which sucks dust within a dust bin of the first cleaner; a second station that is coupled below the first station and includes a second coupling portion to which a second cleaner climbs; a second cleaner suction flow path of which one side is coupled to the second station to suck dust within a dust bin of the second cleaner and of which other side is coupled to the first cleaner suction flow path; a discharge flow path that is provided to discharge air sucked from the first cleaner or the second cleaner. The second cleaner is a cleaner that autonomously travels in an area to be cleaned. One side of the discharge flow path is connected to the housing and the other side of the discharge flow path is connected to the second station, so that air is discharged toward a bottom surface of the second cleaner.

Here, the second coupling portion may be provided with a discharge portion such that air discharged through the discharge flow path is discharged toward a top portion of the second coupling portion.

Also, the second coupling portion may include a suction hole which is disposed at a position corresponding to a position where the dust bin of the second cleaner is disposed, on the basis of a state in which the second cleaner is coupled to the second coupling portion, and sucks air from the dust bin of the second cleaner.

Also, one side of the second cleaner suction flow path may be coupled to the suction hole such that the second cleaner suction flow path sucks the dust within the dust bin of the second cleaner.

Also, the discharge portion may be disposed at a position corresponding to a mop attached to the second cleaner, on the basis of a state in which the second cleaner is coupled to the second station.

Also, the discharge portion may be provided to have an area wider than an area in the second coupling unit occupied by a mop attached to the second cleaner, on the basis of a state in which the second cleaner is coupled to the second station.

Further another embodiment is a cleaner system including: a first station that includes a housing which has an inner space and to which a first cleaner is coupled and a first cleaner suction flow path which sucks dust within a dust bin of the first cleaner; a second station that is coupled below the first station and includes a second coupling portion to which a second cleaner climbs; and a discharge flow path that is provided to discharge air sucked from the first cleaner or the second cleaner. The second cleaner is a cleaner that autonomously travels in an area to be cleaned. One side of the discharge flow path is connected to the housing and the other side of the discharge flow path is connected to the second station, so that air is discharged toward a bottom surface of the second cleaner.

Here, the second coupling portion may be provided with a discharge portion such that air discharged through the discharge flow path is discharged toward a top portion of the second coupling portion.

Also, the discharge portion may be disposed at a position corresponding to a mop attached to the second cleaner, on the basis of a state in which the second cleaner is coupled to the second station.

Also, the discharge portion may be provided to have an area wider than an area in the second coupling unit occupied by a mop attached to the second cleaner, on the basis of a state in which the second cleaner is coupled to the second station.

Advantageous Effect

According to the embodiment of the present disclosure, the first station to which the first cleaner is coupled and the second station to which the second cleaner is coupled are included, so that it is possible to remove the inconvenience for a user to empty the dust in the dust bin of the first cleaner and/or the second cleaner each time.

In addition, according to the embodiment of the present disclosure, in a state in which the first cleaner is coupled to the first station and the second cleaner is coupled to the second station, components are arranged such that the overall balance of the cleaner system is maintained, and therefore, each cleaner and station can be supported stably without being biased to one side.

In addition, according to the embodiment of the present disclosure, air sucked in the process of sucking dust of the dust bin of the first cleaner and/or the second cleaner is discharged toward the bottom of the second cleaner, thereby drying the mop attached to the second cleaner. Accordingly, user convenience that allows hygienic management of the second cleaner can be provided.

DESCRIPTION OF DRAWINGS

FIG. 1 is a cross-sectional side view showing a cleaner system according to an embodiment of the present disclosure;

FIG. 2 shows a first cleaner which is coupled to a first station, in the cleaner system according to the embodiment of the present disclosure;

FIG. 3 is an enlarged view of a dust bin opening and closing structure of the first cleaner, in the cleaner system according to the embodiment of the present disclosure;

FIG. 4 is a view showing an arrangement relationship between the first cleaner and a housing and an outer wall surface arrangement structure of the housing, in the cleaner system according to the embodiment of the present disclosure;

FIG. 5 is an enlarged view of a coupling portion to which the first cleaner is coupled, in the cleaner system according to the embodiment of the present disclosure;

FIG. 6 is a front view of the first station, in the cleaner system according to the embodiment of the present disclosure;

FIG. 7 is a view showing that a fixing unit of the first station is coupled to the coupling portion, in the cleaner system according to the embodiment of the present disclosure;

FIG. 8 is an enlarged view of a door unit of the first station, in the cleaner system according to the embodiment of the present disclosure;

FIG. 9 is an enlarged view of a cover opening unit of a cleaner station, in the cleaner system according to the embodiment of the present disclosure;

FIG. 10 is a view showing an imaginary plane passing through the first cleaner in the cleaner system according to the embodiment of the present disclosure;

FIG. 11 is a view showing a positional relationship between imaginary extension lines a1, a2, a3, a4, and a5 and an imaginary dust collection motor axial line C, in the embodiment of the present disclosure;

FIG. 12 is a view showing that the imaginary plane of FIG. 11 passes through at least a portion of the dust collection motor, in the embodiment of the present disclosure;

FIG. 13 is a view showing that an imaginary second cleaner centerline is disposed within a width of the dust collection motor, based on a state where the cleaner system is viewed from the front, in the embodiment of the present disclosure;

FIG. 14 is a view showing positional relationships between a center of gravity of a suction motor of the first cleaner, a center of gravity of the dust collection motor of the first station, a center of gravity of the second cleaner, in the embodiment of the present disclosure;

FIGS. 15A and 15B are views showing an embodiment in which a second station is coupled to the bottom of the first station and an arrangement relationship between the first cleaner and the second cleaner is different from that of FIG. 1;

FIGS. 15C and 15D are views showing an embodiment in which the second station is coupled to a side of the first station;

FIG. 15C is a view showing an embodiment in which the second station is coupled to a rear surface of the first station;

FIG. 16 is a side view showing schematically an embodiment of the cleaner system including a discharge flow path;

FIG. 17 is a view of the cleaner system of FIG. 16 viewed from the rear;

FIG. 18 is a view showing a bottom surface of the second cleaner which is coupled to the cleaner system of FIG. 16;

FIG. 19 is a mimetic diagram of a top surface of a second coupling portion to which the second cleaner is coupled, in the embodiment of FIG. 16;

FIG. 20 is a side view showing schematically another embodiment of a cleaner system including a discharge flow path;

FIG. 21 is a view of the cleaner system of FIG. 20 viewed from the rear;

FIG. 22 is a view showing a bottom surface of a second cleaner which is coupled to a second station, in the embodiment of FIG. 20; and FIG. 23 is a view showing a second coupling portion of the second station to which the second cleaner is coupled, in the embodiment of FIG. 20.

MODE FOR INVENTION

Hereinafter, preferred embodiments of the present invention will be described in detail with reference to the accompanying drawings.

As the present invention can have various embodiments as well as can be diversely changed, specific embodiments will be illustrated in the drawings and described in detail. While the present invention is not limited to particular embodiments, all modification, equivalents and substitutes included in the spirit and scope of the present invention are understood to be included therein.

Terms used in the present specification are provided for description of only specific embodiments of the present invention, and not intended to be limiting. An expression of a singular form includes the expression of plural form thereof unless otherwise explicitly mentioned in the context.

Unless otherwise defined, all terms used herein including technical and scientific terms have the same meaning as commonly understood by one of ordinary skill in the art to which the present invention belongs. Terms, for example, commonly used terms defined in the dictionary, are to be construed to have exactly the same meaning as that of related technology in the context. As long as terms are not clearly defined in the present application, the terms should not be ideally or excessively construed as formal meaning.

FIG. 1 is a cross-sectional side view of a cleaner system 1 according to an embodiment of the present disclosure.

Referring to FIG. 1, the cleaner system 1 according to the embodiment of the present disclosure may include a first station 10 and a second station 20.

First, a direction is defined. A front of the cleaner system is defined as a direction in which a first cleaner 50 is coupled to the first station. That is, the front of the cleaner system 1 may be defined as a direction in which a first coupling portion 115 of the first station 10, which will be described later, faces. A rear of the cleaner system 1 may be defined as a direction in which an outer wall surface 111*c* disposed opposite to the first coupling portion 115 faces among outer wall surfaces of a housing 110. In addition, a direction in which a long axis L of the housing 110 is disposed may be defined as an up and down direction. Here, one side where the first coupling portion 115 is formed may be an upper portion, and one side where the second station 20 is disposed is a lower portion.

The first station 10 may be coupled to the first cleaner 50. Dust sucked from the inside of a dust bin 516 of the first cleaner 50 may be stored within the first station 10. Also, the first station 10 may include the housing 110 which has an inner space for receiving a plurality of parts provided for this purpose.

The first station 10 may include a first cleaner suction flow path 120. The first cleaner suction flow path 120 may be received in the inner space of the housing 110 and may communicate with the dust bin 516 of the first cleaner 50 when a door 151 to be described later is opened. The first cleaner suction flow path 120 may be arranged within the housing 110 in the up and down direction. The arrangement direction of the first cleaner suction flow path 120 may be substantially parallel to the long axis L of the housing 110. The first cleaner suction flow path 120 may have a space therein formed in a shape of a tube having a passage through which dust moves. In addition, in a possible embodiment, the first cleaner suction flow path 120 may be coupled to a second cleaner suction flow path 25 to be described later with reference to FIG. 15. Through this, the second cleaner suction flow path 25 can be in communication with the first cleaner suction flow path 120.

In addition, when the first cleaner 50 is coupled to the first station 10, the first station 10 may serve as a charging stand which supplies power to the first cleaner 50 and charging it.

The first cleaner 50 may be coupled to the front of the first station 10. More specifically, a cleaner body 510 of the first cleaner 50 may be coupled to the first coupling portion 115 disposed in the front of the first station 10.

The detailed structure of the first station 10 will be described with reference to FIGS. 4 to 9 later.

The second station 20 may be coupled to a second cleaner 60. The second station 20 may be disposed below the first station 10 and may be coupled to the first station 10. In a possible embodiment, the second station 20 may be provided to be coupled integrally to the first station 10. Alternatively, in a possible embodiment, the second station 20 may be prefabricated and coupled to a bottom of the first station 10.

Meanwhile, the first station 10 may include a coupling plate 112 provided below the housing 110, and a bottom surface of the coupling plate 112 may be coupled to a top surface of the second station 20. Here, a cross-sectional area of the coupling plate 112 may be larger than a cross-sectional area of a lower portion of the housing surrounded by the outer wall surface of the housing 110. That is, the coupling plate 112 may have a quadrangular plate shape having a size extending further outward than each corner of the housing 110 that constitutes the outer wall surface. A front end of the coupling plate may protrude further forward than the first cleaner 50 in a state in which the first cleaner 50 is coupled to the first station 10. With this configuration, the coupling plate 112 may serve to prevent dust from falling from a cleaner head 530 of the first cleaner 50 to the second cleaner 60. Also, in the embodiment in which the first station 10 and the second station 20 can be prefabricated and coupled, the coupling plate 112 can serve as a support which enables the first station 10 to stand upright alone on the ground when the first station 10 is separated from the second station 20.

When the second cleaner 60 is coupled to the second station 20, the second station 20 may serve as a charging stand that supplies power to the second cleaner 60 and charge it.

In a preferred embodiment of the present disclosure, the second station 20 may be configured to be coupled to the second cleaner 60 in the same direction as a direction in which the first cleaner 50 is coupled to the first station 10. For example, when the first cleaner 50 is coupled to the front of the first station 10, the second cleaner 60 may also be coupled to the second station 20 in a manner of climbing the second cleaner 60 from the front. As such, when the direction in which the first cleaner 50 is coupled to the first station 10 coincides with the direction in which the second cleaner 60 is coupled to the second station 60, a space of a horizontal plane occupied by the cleaner system 1 can be reduced, an indoor space where the cleaner system 1 is to be disposed can be efficiently formed.

The second station 20 may include a second coupling portion 210 where the second cleaner 60 climbs and is coupled to the top of the second coupling portion 210, and may include a connecting portion 220 which is connected to the bottom of the first station 10.

A top surface of the connecting portion 220 may be connected to the first station 10, and the second coupling portion 210 may be connected to the front of the connecting portion 220. A bottom surface of the connecting portion 220, together with a bottom surface of the second coupling portion 210, may be placed on the ground to serve as a support surface that supports the entire weight of the cleaner system 1. The connecting portion 220 may be provided in the form of a square pillar.

A space may be formed within the second coupling portion 210 and the connecting portion 220. In a possible embodiment, a passage through which dust sucked from the second cleaner 60 flows may be provided in the space. Also, in a possible embodiment, a power module for supplying power to the second cleaner 60 and charging it may be received in the space. For example, the power module may include a converter that converts AC power into DC power.

Also, in a possible embodiment, air sucked by the first cleaner 50 or the second cleaner 60 may be discharged to the space.

The structure of the second coupling portion 210 will be described later with reference to FIGS. 19 and 23.

Meanwhile, "coupling" between the first cleaner 50 and the first station 10 as an expression that will be repeatedly described throughout this specification will be described in detail. The coupling herein is a concept including physical coupling, electrical coupling, and fluid coupling.

Specifically, it can be referred to as physical coupling that the first cleaner 50 is seated on the coupling portion 115 by the user, is fixed and/or sealed to the first station 10 by a mechanical component provided in the first station 10, and thus, is connected in a state where fluid coupling to be described later is possible.

Also, it can be referred to as electrical coupling that a battery of the first cleaner 50 comes into contact with a charging terminal 1156 so that the first cleaner 50 and the first station 10 are connected in a state in which the first cleaner 50 can receive power from the first station 10. Alternatively, it can be referred to as electrical coupling that the first cleaner 50 and the first station 10 are connected in a state in which the physical coupling can be detected by various sensors provided in the first station 10.

Also, it can be referred to as fluid coupling that a door 151 of the first station 10 is opened and a discharge cover 5162 of the first cleaner 50 is also opened, so that the dust bin 516 of the first cleaner 50 and the first cleaner suction flow path 120 of the first station 10 are in communication with each other. The fluid coupling is performed after the above-described physical coupling and/or electrical coupling. In the state of fluid coupling, the air within the dust bin 516 of the first cleaner 50, together with the dust, may pass through the first cleaner suction flow path 120 and may be transferred to a dust collector 140.

The cleaner system 1 according to the embodiment of the present disclosure may further include the first cleaner 50.

Hereinafter, a structure of the first cleaner 50 coupled to the first station 10 according to the embodiment of the present disclosure will be described with reference to FIGS. 2 and 3.

FIG. 2 shows the first cleaner 50 which is coupled to the first station 10, in the cleaner system 1 according to the embodiment of the present disclosure. FIG. 3 is an enlarged view of an opening and closing structure of the dust bin 516 of the first cleaner 50, in the cleaner system 1 according to the embodiment of the present disclosure.

The first cleaner 50 may be a stick cleaner configured such that the user manually cleans a room himself/herself by gripping a handle 514, and the first cleaner 50 may include the cleaner body 510.

The cleaner body 510 of the first cleaner 50 may include a body housing 510*a*, a suction portion 511 that provides a flow path through which air containing dust can flow and is connected to an extension tube 520, a dust separator 512 that communicates with the suction portion 511 and separates dust sucked thereinto through the suction portion 511 through the suction portion 511, a suction motor 513 that generates a suction force for sucking air along the suction portion 511, the handle 514 gripped by the user, a battery housing 515 that receives a battery therein, and the dust bin 516.

Meanwhile, in the embodiment of the present disclosure, a direction of the first cleaner 50 may be defined independently of the direction of the cleaner system 1 defined above.

In the first cleaner 50, a front may mean a direction in which the suction portion 511 is disposed based on the suction motor 513, and a rear may mean a direction in which the handle 514 is disposed based on the suction motor 513. In addition, the direction in which the suction motor 513 and the handle 514 are disposed may be defined as an upward direction, and a direction in which the dust bin 516 and the battery housing 515 are disposed may be defined as a downward direction.

The body housing 510*a* may form an exterior of the first cleaner 50. The body housing 510*a* may provide a space that receives the suction motor 513 and a filter (not shown) therein. For example, the body housing 510*a* may be formed in a shape similar to a cylinder.

The suction portion 511 may be formed in a cylindrical shape with an open interior. The extension tube 520 connected to the suction portion 511 may also have a cylindrical shape to form a passage (or flow path) through which dust sucked from the cleaner head 530 moves to the suction portion 511. Meanwhile, in the embodiment of the present disclosure, an imaginary extension tube through-line a2 passing through the extension tube 520 in the longitudinal direction may be defined. The imaginary extension tube through-line a2 may pass through the inside of the suction portion 511.

Here, the extension tube through-line a2 may include points on a plane obtained by cutting the suction portion 511 in the radial direction along the longitudinal direction (axial direction), and may be an imaginary line formed perpendicular to the plane. For example, the extension tube through-line a2 may be an imaginary line obtained by connecting the origins of circles formed by cutting the cylindrical suction portion 511 in the radial direction along the longitudinal direction (axial direction).

The dust separator 512 may communicate with the suction portion 511. The dust separator 512 may separate dust sucked thereinto through the suction portion 511. A space within the dust separator 512 may communicate with a space within the dust bin 516.

For example, the dust separator 512 may include at least two cyclones capable of separating dust by cyclone flow. Also, the space within the dust separator 512 may communicate with flow paths formed within the extension tube 520 and the suction portion 511. Accordingly, air and dust sucked through the suction unit 511 spirally flow along the inner circumferential surface of the dust separator 512, and through this, a cyclone flow may occur in the space within the dust separator 512.

Meanwhile, in the embodiment of the present disclosure, an imaginary cyclone line a4 that extends in the up and down direction of the dust separator 512 where the cyclone flow occurs may be defined.

Here, the cyclone line a4 may include points on a plane obtained by cutting the dust separator 512 in the radial direction along the up and down direction, and may be an imaginary line formed perpendicular to the plane.

The suction motor 513 may generate a suction force for sucking air. The suction motor 513 may be received within the body housing 510*a* of the cleaner body 510. The suction motor 513 may generate the suction force by rotation. For example, the suction motor 513 may be provided in a shape similar to a cylinder.

Meanwhile, in the embodiment of the present disclosure, an imaginary suction motor axial line a1 obtained by extending the rotational axis of the suction motor 513 may be defined.

The handle 514 can be gripped by a user. The handle 514 may be disposed at the rear of the suction motor 513. In a possible embodiment, the handle 514 may be formed in a shape similar to a cylinder. Alternatively, in a possible embodiment, the handle 514 may be formed in a curved cylindrical shape.

The handle 514 may include a grip portion 514*a* formed in a column shape for allowing the user to hold, a first extension portion 514*b* which is connected to one longitudinal (axial) end of the grip portion 514*a* and extends toward the suction motor 513, and a second extension portion 514*c* which is connected to the other longitudinal (axial) end of the grip portion 514*a* and extends toward the dust bin 516.

Meanwhile, in the embodiment of the present disclosure, an imaginary grip portion through-line a3 that extends in the longitudinal direction (axial direction of the column) of the grip portion 514*a* and passes through the grip portion 514*a* may be defined.

For example, the grip portion through-line a3 may be an imaginary line formed within the cylindrical grip portion 514*a* and may be an imaginary line formed parallel to at least a portion of an outer surface (outer circumferential surface) of the grip portion 514*a*. The handle 514 may be configured such that the grip portion through-line a3 forms a predetermined angle with the suction motor axial line a1 or the cyclone line a4 in consideration of the user's wrist angle during cleaning.

A top surface of the handle 514 may form a partial exterior of a top surface of the first cleaner 50. Through this, it is possible to prevent a component of the first cleaner 50 from coming into contact with the user's arm when the user grips the handle 514.

The first extension portion 514*b* may extend from the grip portion 514*a* toward the suction motor 513. At least a portion of the first extension portion 514*b* may extend in a horizontal direction (front and rear direction of the first cleaner 50).

The second extension portion 514*c* may extend from the grip portion 514*a* toward the dust bin 516. At least a portion of the second extension portion 514*c* may extend in a horizontal direction.

The battery (not shown) of the first cleaner 50 may be received in the battery housing 515. The battery housing 515 may be disposed below the handle 514. For example, the battery housing 515 may have a hexahedral shape with an open bottom. A rear surface of the battery housing 515 may be connected to the handle 514.

The battery housing 515 may include a receiving portion (not shown) that opens downward, and the battery of the first cleaner 50 may be attached or detached through the receiving portion.

The dust bin 516 may be in communication with the dust separator 512 and may store dust separated by the dust separator 512 from sucked air.

Referring to FIG. 3, the dust bin 516 may include a dust bin body 5161, a discharge cover 5162, and a coupling lever 5163.

The dust bin body 5161 may have a cylindrical shape and have open one side. The air introduced through the suction portion 511 passes through the dust separator 512 received in the dust bin body 5161. Here, the dust is collected within the dust bin body 5161, and the air separated from the dust flows to the suction motor 513 and is discharged to the outside of the first cleaner 50.

The discharge cover 5162 may be rotatably coupled to the open one side of the dust bin body 5161. More specifically, the discharge cover 5162 may be coupled to the dust bin body 5161 through the medium of a dust bin hinge 5164 on open one side of the dust bin body 5161. Here, the dust bin hinge 5164 may be disposed on one side close to the battery housing 515. The discharge cover 5162 may pivot on the dust bin hinge 5164 as an axis in such a way as to open or close the dust bin body 5161.

Also, the discharge cover 5162 may include, on one side close to the suction portion 511, a coupling hook (not shown) which is hook-coupled to the dust bin body 5161. The coupling hook and the dust bin hinge 5164 may be disposed opposite to each other.

The coupling lever 5163 may be provided to move along the outer circumferential surface of the dust bin body 5161 in the longitudinal direction of the dust bin body 5161 in order to release the hook-coupling between the discharge cover 5162 and the dust bin body 5161. When an external force is applied to the coupling lever 5163 and the coupling lever 5163 moves in the longitudinal direction of the dust bin body 5161 (a direction in which the hook-coupling is released), the coupling hook provided in a shape extending from the discharge cover 5162 is elastically deformed and then the hook-coupling between the discharge cover 5162 and the dust bin body 5161 can be released.

Meanwhile, in the embodiment of the present disclosure, an imaginary dust bin through-line a5 that passes through the inside (inner space) of the dust bin body 5161 and extends in the longitudinal direction of the dust bin body 5161 (the axial direction in the cylindrical dust bin body 5161) may be formed (see FIG. 2).

Here, the dust bin through-line a5 may include points on a plane obtained by cutting the dust bin 516 in the radial direction along the longitudinal direction, and may be an imaginary line formed perpendicular to the plane. For example, the dust bin through-line a5 may be an imaginary line that passes through the origin of a circle obtained by cutting the dust bin 516 in the radial direction along the longitudinal direction and is perpendicular to the circle.

Referring back to FIG. 2, the first cleaner 50 may include the extension tube 520. The extension tube 520 may communicate with the cleaner head 530. The extension tube 520 may communicate with the cleaner body 510. The extension tube 520 may communicate with the suction portion 511 of the cleaner body 510. The extension tube 520 may be formed in a long cylindrical shape.

The cleaner body 510 may be connected to the cleaner head 530 through the extension tube 520. The cleaner body 510 may generate a suction force by the suction motor 513 and may provide the suction force to the cleaner head 530 through the extension tube 520. External dust that has passed through the cleaner head 530 and the extension tube 520 may be introduced into the cleaner body 510.

The first cleaner 50 may include the cleaner head 530. The cleaner head 530 may communicate with the extension tube 520. Accordingly, external air may flow into the cleaner body 510 via the cleaner head 530 and the extension tube 520 by the suction force generated by the cleaner body 510 of the first cleaner 50.

The cleaner system 1 according to the embodiment of the present disclosure may further include the second cleaner 60.

The second cleaner 60 may be a robot cleaner that autonomously travels in an area to be cleaned. In a possible embodiment, the second cleaner 60 may be provided with a suction port formed in the bottom surface and may suck foreign substances such as dust on the floor while traveling by itself. Alternatively, in a possible embodiment, the second cleaner 60 may be provided with a mop attached to its bottom surface and may perform a mopping operation of wiping the floor with the mop. Alternatively, in a possible embodiment, the second cleaner 60 may be provided with both the above-described suction port and the mop and may simultaneously perform sucking foreign substances and the mopping operation.

The second cleaner 60 may be coupled to the second station 20 by climbing the second coupling portion 210 of the second station 20. In a possible embodiment, when the second cleaner 60 is coupled to the second station 20, dust of the dust bin of the second cleaner 60 may be sucked through an inner space of the second station 20. Alternatively, in a possible embodiment, when the second cleaner 60 is coupled to the second station 20, power is supplied through a charging terminal of the second station 20 and the second cleaner 60 can be charged.

Meanwhile, as described above, the cleaner system 1 according to the embodiment of the present disclosure is configured such that the second station 20 is disposed below the first station 10. The suction motor 513, a dust collection motor 130, and the second cleaner 60 may be arranged in the order listed from the top along the long axis L of the housing 110 in a state where the first cleaner 50 is coupled to the first coupling portion 115 and the second cleaner 60 is coupled to the second coupling portion 210.

In this way, when one cleaner system 1 is configured by arranging the first station 10 to which the first cleaner 50 is coupled and the second station 20 to which the second cleaner 60 is coupled one above the other, it is possible to remove the inconvenience for the user to empty the dust within the dust bin of the first cleaner 50 and/or the second cleaner 60 each time.

In addition, when the cleaners 50 and 60 are coupled to the cleaner system 1 through the above-mentioned arrangement, the first cleaner 50 gripped by the user is positioned relatively higher, there is an advantage that the user can store the first cleaner 50 only by simply pushing user's arm toward the first station 10 while gripping the first cleaner 50 after finishing the cleaning. In addition, since the second cleaner 60 that travels on the floor by itself and moves is coupled below the first cleaner 50, there is an advantage that the second cleaner 60 finishes cleaning and then can easily climb the second coupling portion 210 without consumption of a heavy load.

Also, the first cleaner 50 and the second cleaner 60 can be arranged one above the other and stored in one cleaner system 1. Therefore, a plurality of cleaners is stored by occupying a smaller indoor space of a house, more specifically, a smaller horizontal surface area of an indoor space, so that the user is provided with convenience that allows the user to efficiently use the space.

Also, dust of both the first cleaner 50 and the second cleaner 60 can be removed by one dust collection motor 130, which is more economical than a dust collecting device provided in correspondence to each cleaner.

Also, one dust collector 140 can collect the dust of the first cleaner 50 and the second cleaner 60, and thus, the dust of the first cleaner 50 and the second cleaner 60 can be continuously collected by replacing only the dust collector 140 by the user. Convenience is increased compared to a case in which dust bags provided in two dust collecting devices have to be replaced respectively.

Hereinafter, a structure of the first station 10 will be described in more detail with reference to FIGS. 1 and 4 to 9.

FIG. 4 is a view showing an arrangement relationship between the first cleaner 50 and the housing 110 and an outer wall surface arrangement structure of the housing 110, in the cleaner system 1 according to the embodiment of the present disclosure.

As described above, the first station 10 may include the housing 110.

The housing 110 is a component to which the first cleaner 50 is coupled, and may form an exterior of the first station 10. Specifically, the housing 110 may be formed in a column shape including at least one outer wall surface. For example, the housing 110 may be formed in a shape similar to a quadrangular column.

In the space formed within the housing 110, components such as the first cleaner suction flow path 120, the dust collection motor 130, the dust collector 140, etc., may be received (see FIG. 1).

As described above, the housing 110 may include at least one outer wall surface. For example, the housing 110 may include a first outer wall surface 111*a* on which the coupling portion 115 is formed, and a second outer wall surface 111*b*, the third outer wall surface 111*c*, and a fourth outer wall surface 111*d* which are arranged counterclockwise in the order listed when the first outer wall surface 111*a* is viewed.

The housing 110 may be openable such that some of the parts received therein (e.g., the dust collector 140) are exposed. In a possible embodiment, when the first station 10 is viewed from the front thereof, the second outer wall surface 111*b* and a portion of the right side of the first outer wall surface 111*a* may be integrally opened together in the direction of the second outer wall surface 111*b*, and the fourth outer wall surface 111*d* and a portion of the left side of the first outer wall surface 111*a* may be integrally opened together in the direction of the fourth outer wall surface 111*d*.

The first outer wall surface 111*a* may be formed to be recessed toward the inside of the housing 110 such that the coupling portion 115 formed on the first outer wall surface 111*a* corresponds to the shape of a portion of the cleaner body 510 of the first cleaner 50. With this configuration, a portion of the first cleaner 50 can be coupled to the first station 10, and the first cleaner 50 can be supported by the first station 10. Here, the portion of the first cleaner 50 may mean a certain area of the dust bin 516 and a certain area of the battery housing 515.

Hereinafter, the shape of the coupling portion 115 will be described with reference to FIGS. 5 to 7.

FIG. 5 is an enlarged view of the coupling portion 115 to which the first cleaner 50 is coupled, in the cleaner system 1 according to the embodiment of the present disclosure. FIG. 6 is a front view of the first station 10, in the cleaner system 1 according to the embodiment of the present disclosure. FIG. 7 is a view showing that a fixing unit 160 of the first station 10 is coupled to the coupling portion 150, in the cleaner system 1 according to the embodiment of the present disclosure.

The dust bin 516 and the battery housing 515 of the first cleaner 50 may be coupled to the coupling portion 115. Referring to FIGS. 5 and 6, the coupling portion 115 may include a coupling surface 1151. The coupling surface 1151 may be disposed parallel to the outer wall surface of the housing 110. For example, the coupling surface 1151 may mean a surface formed in a shape of a groove concave toward the inside of the housing 110 from the first outer wall surface 111*a*. That is, the coupling surface 1151 may be formed to have a step difference with respect to the first outer wall surface 111*a*.

The coupling surface 1151 may come into contact with the bottom surfaces of the dust bin 516 and the battery housing 515 of the first cleaner 50. Here, the bottom surface of the dust bin 516 may refer to a surface facing the ground when the user performs cleaning by using the first cleaner 50 or puts the first cleaner 50 on the ground.

A dust passing hole 1151*a* may be formed on the coupling surface 1151 in order to allow external air of the housing 110 to flow into the coupling surface 1151. The dust passing hole 1151*a* may be formed in a hole shape corresponding to the shape of the dust bin 516 such that the dust within the dust bin 516 flows into the dust collector 140. Specifically, the dust passing hole 1151*a* may be formed to correspond to the shape of the discharge cover 5162 such that the dust can pass through the discharge cover 5162 when the discharge cover 5162 of the dust bin 516 is opened. The dust passing hole 1151*a* may be formed to communicate with the first cleaner suction flow path 120.

The coupling portion 115 may include a dust bin guide surface 1152. The dust bin guide surface 1152 may be connected to the first outer wall surface 111*a*. In addition, the dust bin guide surface 1152 may be connected to the coupling surface 1151.

The dust bin guide surface 1152 may be formed in a shape corresponding to the outer surface of the dust bin 516. Through this, it is possible to provide convenience that allows the first cleaner 50 to be coupled to the coupling surface 1151. When the first cleaner 50 is coupled to the first station 10, the dust bin 516 may be supported by the dust bin guide surface 1152.

The coupling portion 115 may include a guide protrusion 1153 (see FIG. 6). The guide protrusion 1153 may be disposed on the coupling surface 1151. The guide protrusion 1153 may protrude from the coupling surface 1151. Two guide protrusions 1153 may be disposed to be spaced apart from each other. A distance between the two guide protrusions 1153 spaced apart from each other may correspond to the width of the battery housing 515 of the first cleaner 50. Through this, it is possible to provide convenience that allows the first cleaner 50 to be coupled to the coupling surface 1151.

The coupling portion 115 may include a coupling portion side wall 1155 (see FIG. 7). The coupling portion side wall 1155 may mean wall surfaces disposed on both sides of the coupling surface 1151, and may be connected perpendicularly to the coupling surface 1151. The coupling portion side wall 1155 may be connected to the first outer wall surface 111*a*. In addition, the coupling portion side wall 1155 may be connected to the dust bin guide surface 1152. That is, the coupling portion side wall 1155 may form a surface connected to the dust bin guide surface 1152. Through this, the first cleaner 50 can be prevented from shaking left and right, and the first station 10 can stably receive the first cleaner 50.

The coupling portion 115 may include a coupling sensor (not shown). The coupling sensor may detect whether or not the first cleaner 50 is coupled to the coupling portion 115.

The coupling sensor may include a contact sensor. For example, the coupling sensor may include a micro switch. Here, the coupling sensor may be disposed on the guide protrusion 1153. Therefore, when the battery housing 515 of the first cleaner 50 is coupled between a pair of guide protrusions 1153, the coupling sensor can detect the first cleaner 50 through contact with the battery housing 515.

Meanwhile, the coupling sensor may also include a non-contact sensor. For example, the coupling sensor may include an infrared sensor (IR sensor). Here, the coupling sensor may be disposed on the coupling portion side wall 1155 and may face the dust bin 516 or the battery housing 515 of the first cleaner 50.

The coupling sensor further detects whether or not power is applied to the battery of the first cleaner 50 as well as detects the first cleaner 50, thereby finally determining whether the first cleaner 50 is coupled to the coupling portion 115.

Here, when the battery of the first cleaner 50 is electrically coupled to a first cleaner charging terminal 1156, it may be determined that power is applied to the battery. The first cleaner charging terminal 1156 may be provided on the coupling surface 1151 and may supply power to the first cleaner 50 when coupled to the battery of the first cleaner 50.

The coupling portion 115 may further include a fixing member entry and exit hole 1157 (see FIG. 7). The fixing member entry and exit hole 1157 may be formed in the form of a long hole along the coupling portion side wall 1155 such that a fixing member 161 to be described later can enter and exit. For example, the fixing member entry and exit hole 1157 may be a rectangular hole formed along the coupling portion side wall 1155. Details of the fixing member 161 will be described later together with the fixing unit 160.

The first station 10 may further include a top cover 113.

Referring to FIG. 6, the top cover 113 may be disposed on the top in the long axis direction of the housing 110. The housing 110 may be formed in a shape in which the top in the long axis direction is opened through the top cover 113. That is, a portion of the inner space of the housing 110 may communicate with the outside of the housing 110 at the top of the housing 110. The coupling portion 115 may extend to the open top of the housing 110.

The top cover 113 may be provided to open and close the top end of the housing 110. The top cover 113 may be coupled to the housing 110 through a hinge to open and close the housing 110. More specifically, the top cover 113 may be coupled on one side of the top end of the housing 110 through a hinge, and may open and close the top end of the housing 110 by pivoting around the hinge. Here, the hinge may be coupled to a surface opposite to a surface of the housing 110 on which the coupling portion 115 is provided. In a possible embodiment, when the coupling portion 115 is provided on the first outer wall surface 111*a* of the housing 110, the hinge may be coupled to the third outer wall surface 111*c*. Accordingly, the top cover 113 may open the top end of the housing 110 while pivoting in a direction away from the first outer wall surface 111*a*.

The first station 10 may further include the dust collector 140.

Referring back to FIG. 1, the dust collector 140 may be received within the housing 110 and may be disposed above the dust collection motor 140. When the dust collector 140 is disposed above the dust collection motor 130 and the dust collection motor 130 generates a suction force, the dust sucked from the inside of the dust bin 516 of the first cleaner 50 and/or a dust bin 610 of the second cleaner 60 may be collected in the dust collector 140.

The dust may be collected in the dust collector 140 through a first suction path including the dust bin 516 of the first cleaner 50, the first cleaner suction flow path 120, and the dust collector 140. Also, the dust may be collected in the dust collector 140 through a second suction path including the dust bin 610 of the second cleaner 60, the second cleaner suction flow path 25 to be described below, the first cleaner suction flow path 120, and the dust collector 140.

The dust collector 140 may be coupled to the housing 110 in an attachable and detachable manner. Accordingly, when the housing 110 is opened, the dust collector 140 may be separated from the housing 110 and discarded, and a new dust collector 140 may be coupled to the housing 110. That is, the dust collector 140 may be defined as a consumable part.

When a suction force is generated by the dust collection motor 130, the volume of the dust collector 140 may increase and dust is received in the dust collector. To this end, the dust collector 140 may be made of a material that transmits air but does not transmit foreign substances such as dust. For example, the dust collector 140 may be made of a non-woven fabric material and may have a hexahedral shape based on an increase in volume.

Meanwhile, one side end of the first cleaner suction flow path 120 may be coupled to the dust passing hole 1151*a* and the other side end of the first cleaner suction flow path 120 may be coupled to the dust collector 140. Therefore, when the dust collection motor 130 is driven to generate a suction force, a flow of air flowing from one side end to the other side end of the first cleaner suction flow path 120 occurs, and air which includes foreign substances and flows from the inside of the dust bin 516 of the first cleaner 50 moves to the dust collector 140 through the first cleaner suction flow path 120. Also, only the foreign substances remain in the dust collector 140 and the air exits the dust collector 140.

The first station 10 may further include the fixing unit 160.

Referring to FIG. 7, a portion of the fixing unit 160 may be disposed on the coupling portion side wall 1155. Also, a portion of the fixing unit 160 may be disposed behind the coupling surface 1151 and be received within the housing 110.

The fixing unit 160 may fix the first cleaner 50 coupled to the coupling surface 1151. More specifically, the fixing unit 160 may fix the battery housing 515 and the dust bin 516 of the first cleaner 50 coupled to the coupling surface 1151.

The fixing unit 160 may include the fixing member 161, a fixing portion motor 162, and a fixed sealer 163.

The fixing member 161 may receive power from the fixing portion motor 162 and may perform a reciprocating movement from the inside of the coupling portion side wall 1155 of the coupling portion 115 toward the dust bin. The fixing member 161 may enter and exit the coupling portion side wall 1155 through the fixing member entry and exit hole 1157. The upper portion of the fixing member 161 may be formed in a shape corresponding to the shape of the battery housing 515, and the lower portion of the fixing member 161 may be formed in a shape corresponding to the shape of the dust bin body 5161.

With this configuration, when the fixing member 161 rotates to surround the dust bin 516 and the battery housing 515, it is possible to prevent a separated space from being formed between the dust bin 516 and the fixing member 161 and between the battery housing 515 and the fixing member 161, and it is possible to prevent the dust within the dust bin 516 from scattering to the outside of the first station 10 when dust is sucked by the dust collection motor 130.

The fixing portion motor 162 may provide power for moving the fixing member 161. Specifically, the fixing member 161 may be moved by the fixing portion motor 162 from the inside of the coupling portion side wall 1155 in a direction of pressing the dust bin 516, so that the first cleaner 50 can be fixed to the first station 10. Alternatively, the fixing member 161 may move from a position where the dust bin 516 is pressed to the inside of the coupling portion side wall 1155, so that the state in which the first cleaner 50 is fixed to the first station 10 can be released.

The fixed sealer 163 may be disposed on the dust bin guide surface 1152 to seal the dust bin 516 when the first cleaner 50 is coupled. With this configuration, when the dust bin 516 of the first cleaner 50 is coupled, the fixed sealer 163 can be pressed by the weight of the cleaner 50, and the dust bin 516 and the dust bin guide surface 1152 can be sealed such that the flow of air does not leak.

The first station 10 may further include a door unit 150.

FIG. 8 is an enlarged view of the door unit 150 of the first station 10, in the cleaner system 1 according to the embodiment of the present disclosure.

Referring to FIG. 8, the door unit 150 is disposed from the coupling portion 115 to the rear of the coupling portion 115 and may include the door 151, a door arm 152, and a door motor 153.

The door 151 is disposed on the coupling portion 115 and has a structure that can be opened such that the outside of the housing 110 communicates with the internal flow path 120. More specifically, the door 151 is coupled to a door hinge 154 within the housing 110, rotates about the door hinge 154 and moves toward the upper side of the inside of the housing 110. Through this, the inside and outside of the housing 110 can be opened or closed. More specifically, the door hinge 154 may be disposed at the upper end of the dust passing hole 1151*a* on the opposite surface of the coupling surface 1151, and the door 151 may be coupled to the door hinge 154 may be disposed in a position where the dust passing hole 1151*a* is closed.

Here, the state where the door 151 is opened may mean a state where the door 151 rotates about the door hinge 154 in a first direction toward the inner space of the housing 110 and then opens the dust passing hole 1151*a* and the outside of the housing 110 is in communication with the first cleaner suction flow path 120.

Also, the state where the door 151 is closed may mean a state where the door 151 rotates about the door hinge 154 in a second direction opposite to the first direction and then closes the dust passing hole 1151*a* and the outside of the housing 110 and the first cleaner suction flow path 120 are blocked by the door 151 and are not in communication with each other.

The door 151 may be formed in a shape corresponding to the dust passing hole 1151*a* in order to close the inner space and the outside of the housing 110 by blocking the dust passing hole 1151*a* or in order to open the inner space and the outside of the housing 110 by opening the dust passing hole 1151*a*. For example, the door 151 may be formed in a circular shape.

The door arm 152 may connect the door 151 and the door motor 153 and may open and close the door 151 by using power generated by the door motor 153.

For example, the door arm 152 may include a first door arm 152*a* and a second door arm 152*b*. One side end of the first door arm 152*a* may be coupled to the door motor 153. The first door arm 152*a* may rotate by the power transmitted by the door motor 153. The other side end of the first door arm 152*a* may be rotatably coupled to the second door arm 152*b*. The first door arm 152*a* may transmit the power transmitted from the door motor 153 to the second door arm 152*b*. One side end of the second door arm 152*b* may be coupled to the first door arm 152*a*. The other side end of the second door arm 152*b* may be coupled to the door 151. The second door arm 152*b* may push or pull the door 151.

The door motor 153 may provide power for rotating the door 151 to the door arm 152. Specifically, the door motor 153 may rotate the door arm 152 in the forward or reverse direction. Here, the forward direction may mean the first direction, that is, a direction in which the door arm 152 pulls the door 151 toward the inside of the housing 110. Also, the reverse direction may mean the second direction, that is, a direction in which the door arm 152 pushes the door 151 toward the outside of the housing 110. The door motor 153 may include at least one mechanical part for transmitting power to the door arm 152 and the door 151.

The first station 10 may further include a cover opening unit 170.

FIG. 9 is an enlarged view of the cover opening unit 170 of the cleaner station 10, in the cleaner system 1 according to the embodiment of the present disclosure.

Referring to FIG. 9, the cover opening unit 170 is disposed within the housing 110 and below the coupling portion 115 to open the discharge cover 5162 of the first cleaner 50. The cover opening unit 170 may include a push protrusion 171, a cover opening gear 172, and a cover opening motor (not shown).

The push protrusion 171 may be disposed at a position where the coupling lever 5163 can be pressed when the first cleaner 50 is coupled to the coupling portion 115. The push protrusion 171 may perform a linear reciprocating motion in such a way as to press the coupling lever 5163. Specifically, the push protrusion 171 may be disposed on the dust bin guide surface 1152. A protrusion movement hole may be formed on the dust bin guide surface 1152, and the push protrusion 171 may pass through the protrusion movement hole and be exposed to the outside. The push protrusion 171 may be coupled to the cover opening gear 172 and may move together by the movement of the cover opening gear 172.

The cover opening motor may provide power for moving the push protrusion 171 to the cover opening gear 172.

The cover opening gear 172 may be coupled to the cover opening motor and may move the push protrusion 171 by using the power of the cover opening motor. More specifically, the cover opening gear 172 may include a first cover opening gear 172*a* and a second cover opening gear 172*b*. The first cover opening gear 172*a* receives rotation power from a shaft of the cover opening motor. The second cover opening gear 172*b* meshes with the first cover opening gear 172*a* and transmits the linear reciprocating motion to the push protrusion 171.

Here, the first cover opening gear 172*a* may be composed of a pinion gear, and the second cover opening gear 172*b* may be composed of a rack gear.

In other words, when the cleaner body 510 of the first cleaner 50 is fixed to the coupling portion 115, the cover opening motor moves the push protrusion 171 through the cover opening gear 172, thereby separating the discharge cover 5162 from the dust bin body 5161.

Meanwhile, in this way, the first cleaner 50 is coupled to the first station 10, and the dust within the dust bin 516 of the first cleaner 50 is collected to the dust collector 140 by the suction force of the dust collection motor 130. With this configuration, it is possible to remove the inconvenience for the user to empty the dust bin of the stick cleaner each time. Also, when the first cleaner 50 is coupled to the first station 10, the dust bin 516 of the first cleaner 50 is automatically opened by the door unit 150 and the cover opening unit 170, so that the user does not have to touch the dust bin 516, convenience can be increased.

Hereinafter, preferred arrangement relationship of the components that allows the cleaner system 1 to maintain weight balance in a state in which the first cleaner 50 is coupled to the first station 10 and the second cleaner 60 is coupled to the second station 20 will be described with reference to FIGS. 10 to 14.

FIG. 10 is a view showing an imaginary plane S1 passing through the first cleaner 50 in the cleaner system 1 according to the embodiment of the present disclosure.

Referring to FIG. 10, the cleaner system 1 according to the embodiment of the present disclosure may include the imaginary plane S1 formed to pass through the first cleaner 50.

More specifically, the imaginary plane S1 may include at least two of the suction motor axial line a1, the extension tube through-line a2, the grip portion through-line a3, the cyclone line a4, the dust bin through-line a5, and a dust collection motor axial line C. That is, the imaginary plane S1 may be an imaginary plane formed by connecting two imaginary straight lines to each other, and may include an imaginary plane formed by extending and expanding the imaginary plane.

As a possible embodiment, the imaginary plane S1 may include the extension tube through-line a2 and the suction motor axial line a1. Alternatively, as a possible embodiment, the plane S1 may further include the grip portion through-line a3. Alternatively, as a possible embodiment, the plane S1 may include the suction motor axial line a1 and the grip portion through-line a3. Alternatively, as a possible embodiment, the plane S1 may include the cyclone line a4 and the grip portion through-line a3. Alternatively, as a possible embodiment, the plane S1 may include the dust bin through-line a5 and the extension tube through-line a2. Alternatively, as a possible embodiment, the plane S1 may include the dust bin through-line a5 and the grip portion through-line a3. Alternatively, as a possible embodiment, the plane S1 may include the extension tube through-line a2 and the grip portion through-line a3. Alternatively, as a possible embodiment, the plane S1 may include the dust collection motor axial line C and the suction motor axial line a1. Alternatively, as a possible embodiment, the plane S1 may include the dust collection motor axial line C and the extension tube through-line a2. Alternatively, as a possible embodiment, the plane S1 may include the dust collection motor axial line C and the grip portion through-line a3. Alternatively, as a possible embodiment, the plane S1 may include the dust collection motor axial line C and the cyclone line a4. Alternatively, as a possible embodiment, the plane S1 may include the dust collection motor axial line C and the dust bin through-line a5.

FIG. 11 is a view showing a positional relationship between the imaginary extension lines a1, a2, a3, a4, and a5 and the imaginary dust collection motor axial line C, in the embodiment of the present disclosure.

Referring to FIG. 11, when the first cleaner 50 is coupled to the first station 10 in the cleaner system 1 according to the embodiment of the present disclosure, the extension tube through-line a2 may form a crossing with the suction motor axial line a1, the grip portion through-line a3, the cyclone line a4, and the dust bin through-line a5.

In a possible embodiment, the extension tube through-line a2 may perpendicularly cross the suction motor axial line a1. Here, a crossing P1 between the suction motor axial line a1 and the extension tube through-line a2 may exist.

Also, in a possible embodiment, the suction motor axial line a1 and the grip portion through-line a3 may cross at a predetermined angle. A crossing between the suction motor axial line a1 and the grip portion through-line a3 may be disposed farther from the first station 10 than P1.

Also, in a possible embodiment, a crossing P2 between the extension tube through-line a2 and the grip portion through-line a3 may exist.

Also, in a possible embodiment, the extension tube through-line a2 may perpendicularly cross the cyclone line a4. Here, a crossing P3 between the extension tube through-line a2 and the cyclone line a4 may exist.

Also, in a possible embodiment, the extension tube through-line a2 may perpendicularly cross the dust bin through-line a5. Here, a crossing P4 between the extension tube through-line a2 and the dust bin through-line a5.

When the first cleaner 50 is coupled to the first station 10, the extension tube through-line a2 may be formed in parallel to the dust collection motor axial line C. With this configuration, there is an effect of minimizing a space occupied on a horizontal plane by the first cleaner 50 in the state where the first cleaner 50 is coupled to the first station 10.

In a possible embodiment, when the first cleaner 50 is coupled to the first station 10, the cyclone line a4 may cross the dust collection motor axial line C. Here, a crossing P5 between the cyclone line a4 and the dust collection motor axial line C may exist. The crossing P5 between the cyclone line a4 and the dust collection motor axial line C may be located within the housing 110, and more specifically, within the first cleaner suction flow path 120. With this configuration, the first cleaner 50 can be stably supported by the first station 10, and flow loss is reduced when the user is emptying the dust bin 516.

In a possible embodiment, the grip portion through-line a3 may cross the dust collection motor axial line C at a predetermined angle. Here, a crossing P6 between the grip portion through-line a3 and the dust collection motor axial line C may be located within the housing 110. With this configuration, the user can couple the first cleaner 50 to the first station 10 by simply pushing his/her arm toward the first station 10 while holding the first cleaner 50. Also, since the relatively heavy dust collection motor 130 is received within the housing 110, even if the user pushes the first cleaner 50 into the first station 10 strongly, the first station 10 is prevented from shaking.

In a possible embodiment, a height of P5 from the ground may be equal to or less than the maximum height of the first station 10. Also, in a possible embodiment, the height of P5 from the ground may be equal to a height of P4. Also, in a possible embodiment, the height of P5 from the ground may be equal to a height of P1. Also, in a possible embodiment, a height of P2 from the ground may be equal to or less than the maximum height of the housing 110. With this configuration, a total volume in the state where the first cleaner 50 is coupled to the first station 10 can be minimized.

FIG. 12 is a view showing that the imaginary plane S1 of FIG. 10 passes through at least a portion of the dust collection motor 130, in the embodiment of the present disclosure. FIG. 13 is a view showing that an imaginary second cleaner centerline is disposed within a width of the dust collection motor, based on a state where the cleaner system is viewed from the front, in the embodiment of the present disclosure. FIG. 14 is a view showing positional relationships between a center of gravity of the suction motor of the first cleaner, a center of gravity of the dust collection motor of the first station, a center of gravity of the second cleaner, in the embodiment of the present disclosure.

Referring to FIG. 12, in a possible embodiment of the present disclosure, the plane S1 may be configured to pass through at least a portion of the first station 10 in the state in which the first cleaner 50 is coupled to the first station 10. In other words, when the first cleaner 50 is coupled to the first station 10, the plane S1 may pass through the housing 110.

In a preferred embodiment of the present disclosure, the plane S1 may be configured to pass through at least a portion of the dust collection motor 130 in the state in which the first cleaner 50 is coupled to the first station 10. In this case, the total load of the first cleaner 50 is concentrated on an area where the dust collection motor 130 is disposed. Here, the dust collection motor 130 is heavier than the first cleaner 50. Therefore, when the plane passes through the area where the dust collection motor 130 is disposed, a balance is maintained such that the cleaner system 1 does not fall to the left or right.

In a more preferred embodiment of the present disclosure, the plane S1 may be configured to include the axial line C of the dust collection motor 130 in the state where the first cleaner 50 is coupled to the first station 10. In this case, the total load of the first cleaner 50 is concentrated on the center of the dust collection motor 130. Here, the dust collection motor 130 is heavier than the first cleaner 50. Therefore, when the plane passes through the dust collection motor axial line C, the left and right balance of the cleaner system 1 can be perfectly maintained without leaning to either side.

On the other hand, the cleaner system 1 according to the embodiment of the present disclosure may further include the imaginary second cleaner centerline a6 which passes through the center of gravity G2 of the second cleaner 60 and is orthogonal to the bottom surface of the second cleaner 60.

In a possible embodiment, the second cleaner centerline a6 may be disposed to form a predetermined angle with the dust collection motor axial line C (see FIG. 14). Also, in a possible embodiment, the second cleaner centerline a6 may be disposed to form a predetermined angle with the extension tube through-line a2. Also, in a possible embodiment, the second cleaner centerline a6 may form a crossing with the dust collection motor axial line C. Also, in a possible embodiment, the second cleaner centerline a6 may form a crossing with the extension tube through-line a2.

Referring to FIG. 13, in a preferred embodiment of the present disclosure, when the second cleaner 60 is coupled to the second station 20, the second cleaner centerline a6 may be disposed within a width D of the dust collection motor 130 as the first station 10 is viewed from the front. In this case, as the cleaner system 1 is viewed from the front, the center of gravity G3 of the second cleaner 60 does not deviate from an arrangement area of the dust collection motor 130 that is a relatively heavy component in the cleaner system 1. When the second cleaner 60 is coupled to the second station 20, the cleaner system 1 may shake due to the weight of the second cleaner 60. Here, as described above, when the cleaner system 1 is configured such that the second cleaner centerline a6 is disposed within the width D of the dust collection motor 130, a balance can be maintained such that the cleaner system 1 does not shake left or right when the second cleaner 60 is coupled to the second station 20.

In a more preferred embodiment of the present disclosure, when the second cleaner 60 is coupled to the second station 20, the second cleaner centerline a6 may be disposed to coincide with the dust collection motor axial line C as the first station 10 is viewed from the front. In this case, as the cleaner system 1 is viewed from the front, the center of gravity G3 of the second cleaner 60 is aligned with the center of the dust collection motor 130 that is the heaviest component in the cleaner system 1. More specifically, the center of gravity G3 of the second cleaner 60 is disposed to pass through a center of gravity G2 of the dust collection motor 130. Accordingly, a balance can be maintained more perfectly such that the cleaner system 1 does not shake left or right when the second cleaner 60 is coupled to the second station 20.

Referring to FIG. 14, in a preferred embodiment of the present disclosure, the dust collection motor 130 and the second cleaner 60 may be disposed closer to the ground than the cleaner body 510 of the first cleaner 50 (because they are disposed below the suction motor 513 that is a heavy component in the cleaner body 510). Therefore, the overall center of gravity of the cleaner system 1 can be formed to be lower, and the cleaner system 1 can stably maintain a balance similarly to a roly-poly.

This will be described in more detail below.

The center of gravity of the suction motor 513 that is the heaviest component of the first cleaner 50 is referred to as G1, and the center of gravity of the second cleaner 60 is referred to as G2. The center of gravity of the dust collection motor 130 that is the heaviest component among all the components of the cleaner system 1 is referred to as G3.

In a preferred embodiment of the present disclosure, the center of gravity G2 of the second cleaner 60 may be disposed behind the center of gravity G1 of the suction motor 513 in the state where the first cleaner 50 is coupled to the first station 10 and the second cleaner 60 is coupled to the second station 20.

As the dust bin 516 is coupled to the first coupling portion 115 when the first cleaner 50 is coupled to the first station 10, the suction motor 513 located opposite to the dust bin 516 relatively protrudes forward from the cleaner system 1. Therefore, there is a concern that the center of gravity is biased toward the front side. Here, the center of gravity G2 of the second cleaner 60 coupled to the second station 20 is disposed behind the center of gravity G1 of the suction motor 513, so that the front-rear balance can be maintained.

In a more preferred embodiment of the present disclosure, the center of gravity G2 of the second cleaner 60 may be disposed between the center of gravity G1 of the suction motor 513 and the center of gravity G3 of the dust collection motor 130 in the state where the first cleaner 50 is coupled to the first station 10 and the second cleaner 60 is coupled to the second station 20. The center of gravity G2 of the second cleaner 60 disposed at the lowest position is intended to be disposed between the center of gravity G1 of the suction motor 513 and the center of gravity G3 of the dust collection motor 130, which are relatively higher than the second cleaner. As a result, the front-rear balance can be maintained more perfectly.

Meanwhile, hereinafter, various embodiments of a positional relationship between the first station and the second station and a direction in which the second cleaner is coupled to the second station will be described with reference to FIGS. 15A to 15E.

FIGS. 15A and 15B are views showing an embodiment in which the second station is coupled to the bottom of the first station and an arrangement relationship between the first cleaner and the second cleaner is different from that of FIG. 1.

Referring to FIG. 15A, in a possible embodiment, the second station 20 may be coupled below the first station 10. More specifically, the top surface of the connecting portion 220 of the second station 20 and the bottom surface of the coupling plate 112 of the first station 10 may be coupled to each other.

Here, a difference from the embodiment described in FIGS. 1 to 14 is the arrangement relationship between the second cleaner 60 and the first cleaner 50. In this embodiment, when the cleaner system 1 is viewed from the side, the first cleaner 50 and the second cleaner 60 are arranged in opposite directions with respect to the long axis L of the housing 110. Unlike this, in the embodiment described in FIGS. 1 to 14, when the cleaner system 1 is viewed from the side, the first cleaner 50 and the second cleaner 60 are arranged in the same direction with respect to the long axis L of the housing 110.

From another point of view, in this embodiment, when the cleaner system 1 is viewed from the side, the center of gravity G1 of the suction motor 513 and the center of gravity G2 of the second cleaner 60 may be arranged in opposite directions with respect to the long axis L of the housing 110.

From another point of view, in this embodiment, the direction in which the first cleaner 50 is coupled to the first station 10 may be the front of the cleaner system 1, and the direction in which the second cleaner 60 is coupled to the second station 20 may be the rear of the cleaner system 1. That is, the first cleaner 50 and the second cleaner 60 may be coupled to the cleaner system 1 in opposite directions.

Referring to FIG. 15B, in a possible embodiment, the second station 20 may be coupled below the first station 10. More specifically, the top surface of the connecting portion 220 of the second station 20 and the bottom surface of the coupling plate 112 of the first station 10 may be coupled to each other.

Here, in this embodiment, the direction in which the first cleaner 50 is coupled to the first station 10 and the direction in which the second cleaner 60 is coupled to the second station 20 may form a predetermined angle with each other.

For example, when the direction in which the first cleaner 50 is coupled to the first station 10 is the front of the cleaner system 1, the direction in which the second cleaner 60 is coupled to the second station 20 may be the left side of the cleaner system 1 or the right side of the cleaner system 1. In this case, the predetermined angle may be 90 degrees. That is, in this embodiment, the direction in which the first cleaner 50 is coupled to the stations 10 and 20 respectively and the direction in which the second cleaner 60 is coupled to the stations 10 and 20 respectively may be twisted at an angle of 90 degrees.

Meanwhile, the arrangement relationship shown in FIGS. 1, 15A, and 15B may be implemented depending on the user's convenience in a manner of changing a direction in which the coupling plate 112 and the connecting portion 220 are assembled when the first station 10 and the second station 20 are assembled.

For example, when the user assembles the first station 10 and the second station 60, the embodiment of FIG. 1 can be implemented by arranging the second coupling portion 210 in such a manner that the second coupling portion 210 faces the front of the cleaner system 1.

Alternatively, when the user assembles the first station 10 and the second station 60, the embodiment of FIG. 15A can be implemented by arranging the second coupling portion 210 in such a manner that the second coupling portion 210 faces the rear of the cleaner system 1.

Alternatively, when the user assembles the first station 10 and the second station 60, the embodiment of FIG. 15B can be implemented by arranging the second coupling portion 210 in such a manner that the second coupling portion 210 faces the left side or right side of the cleaner system 1.

In other words, the user is able to freely implement all arrangement relationships of the above-described embodiment as needed, by changing the assembling direction of the first station 10 and the second station 20.

In this way, the arrangement direction of the second station 20 is changed according to the assembling direction, so that there is an advantage that convenience which allows the user to arrange the cleaner system 1 without being limited to the shape of an indoor space.

FIGS. 15C and 15D are views showing an embodiment in which the second station 20 is coupled to a side of the first station 10.

Referring to FIGS. 15C and 15D, in a possible embodiment, the second station 20 may be coupled to the side of the first station 10. More specifically, the second station 20 may be coupled to the second outer wall surface 111*b* or the fourth outer wall surface 111*d* of the housing 110.

Here, as shown in FIG. 15C, the direction in which the first cleaner 50 is coupled to the first station 10 and the direction in which the second cleaner 60 is coupled to the first station 10 may be the same as each other. That is, when the direction in which the first cleaner 50 is coupled to the first station 10 is the front of the cleaner system 1, the direction in which the second cleaner 60 is coupled to the second station 20 may also be the front of cleaner system 1.

Unlike this, as shown in FIG. 15D, the direction in which the first cleaner 50 is coupled to the first station 10 and the direction in which the second cleaner 60 is coupled to the second station 20 may form a predetermined angle with each other.

For example, when the direction in which the first cleaner 50 is coupled to the first station 10 is the front of the cleaner system 1, the direction in which the second cleaner 60 is coupled to the second station 20 may be the left side of the cleaner system 1 or the right side of the cleaner system 1. In this case, the predetermined angle may be 90 degrees. That is, in this embodiment, the direction in which the first cleaner 50 is coupled to the stations 10 and 20 respectively and the direction in which the second cleaner 60 is coupled to the stations 10 and 20 respectively may be twisted at an angle of 90 degrees.

FIG. 15C is a view showing an embodiment in which the second station is coupled to a rear surface of the first station.

Referring to FIG. 15E, in a possible embodiment, the second station 20 may be coupled to the rear surface of the first station 10. More specifically, the second station 20 may be coupled to the third outer wall surface 111*c* of the housing 110.

Here, in this embodiment, when the cleaner system 1 is viewed from the side, the first cleaner 50 and the second cleaner 60 may be disposed in opposite directions with respect to the long axis L of the housing.

In addition, in this embodiment, when the cleaner system 1 is viewed from the side, the center of gravity G1 of the suction motor 513 and the center of gravity G2 of the second cleaner 60 may be arranged in opposite directions with respect to the long axis L of the housing 110.

Meanwhile, as shown in the embodiments of FIGS. 15*c* to 15*e*, when the second station 20 is coupled to the side or rear surface of the first station 10 instead of below the first station 10, the overall height of the cleaner system 1 can be reduced. Through this, the overall center of gravity of the cleaner system 1 can be lowered, thereby increasing structural stability.

Hereinafter, embodiments including a discharge flow path for drying a mop of the second cleaner among possible embodiments of the cleaner system according to the embodiment of the present disclosure will be described with reference to FIGS. 16 to 23.

FIG. 16 is a side view showing schematically an embodiment of a cleaner system 1A including a discharge flow path 28.

Referring to FIG. 16, the cleaner system 1A according to the embodiment of the present disclosure may further include the second cleaner suction flow path 25 in the embodiment of FIG. 1.

The configuration except for the second cleaner suction flow path 25 and the discharge flow path 28 to be described later is the same as that of the embodiment of FIG. 1. Therefore, descriptions thereof will be omitted herein. The configuration of the first cleaner 50 is also the same as that described in the embodiment of FIG. 1 and thus will be omitted herein.

One side of the second cleaner suction flow path 25 may be coupled to the second station 20 to suck dust within the dust bin 610 of the second cleaner 60. The other side of the second cleaner suction flow path 25 may be coupled to the first cleaner suction flow path 120 within the housing 110 of the first station 10. Through this, the first cleaner suction flow path 120 and the second cleaner suction flow path 25 may communicate with each other. The second cleaner suction flow path 25 may have a space therein formed in a shape of a tube having a passage through which dust moves.

As a possible embodiment, the second cleaner suction flow path 25 may be received in the inner space of the housing 110 and the inner space of the second station 20 so as not to be exposed to the outside of the cleaner system 1A. Alternatively, as a possible embodiment, at least a portion of the second cleaner suction flow path 25 may be disposed to be exposed to the outside of the housing 110 for efficiency of the inner space of the housing 110.

More specifically, one side end of the second cleaner suction flow path 25 coupled to the second station 20 may be coupled to a lower portion of a suction hole 211 of the second coupling portion 210. More specifically, when the second cleaner 60 is coupled to the second coupling portion 210, a dust discharge hole 620 of the second cleaner 60 is disposed on an upper portion of the suction hole 211. When a suction force is provided to the second cleaner suction flow path 25, dust within the dust bin 610 of the second cleaner 60 may move to the second cleaner suction flow path 25 (see FIGS. 18 and 19).

Meanwhile, the other side end of the second cleaner suction flow path 25 coupled to the first cleaner suction flow path 120 may be disposed above the dust collection motor 130. With this configuration, a suction force is provided to the second cleaner suction flow path 25 to suck the dust within the dust bin 610 of the second cleaner 60. The other side end of the second cleaner suction flow path 25 may be disposed above the dust collector 140. With this configuration, dust flowing through the second cleaner suction flow path 25 may be collected in the dust collector 140.

A flow path switching portion (not shown) may be disposed at the other side end of the second cleaner suction flow path 25 that switches a flow path of the first cleaner suction flow path 120 and a flow path of the second cleaner suction flow path 25. For example, the flow path switching portion may be a flow path switching valve.

As such, with the configuration in which the second cleaner 60 is coupled to the second station 20 and the dust within the dust bin 610 of the second cleaner 60 is collected to the dust collector 140 by the suction force of the dust collection motor 130, it is possible to remove the inconvenience for the user to empty the dust bin of the robot cleaner each time. Also, the dust can be prevented from scattering when the user directly empties the dust bin of the robot cleaner. The cleaner system 1A according to the embodiment of the present disclosure may further include the discharge flow path 28.

The discharge flow path 28 may be provided to discharge air sucked from the inside of the dust bin 516 of the first cleaner 50. Also, the discharge flow path 28 may be provided to discharge air sucked from the inside of the dust bin 610 of the second cleaner 60.

Referring to FIG. 16, one side of the discharge flow path 28 may be connected to the housing 110 of the first station 10 and the other side may be connected to the second station 20. More specifically, the other side of the discharge flow path 28 may be connected to an inner space of the second coupling portion 210, and thus, the discharged air may be discharged toward the bottom surface of the second cleaner 60.

As a possible embodiment, one side end of the discharge flow path 28 may be formed in a tubular shape in which one side end is disposed below the dust collection motor 130 within the housing 110 and the other side end extends into the inner space of the second coupling portion 210.

Alternatively, as a possible embodiment, a hole may be formed at the lower portion of the housing 110, and the discharge flow path 28 may be formed in a tubular shape in which one side end is disposed in the hole and the other side end extends into the inner space of the second coupling portion 210.

FIG. 17 is a view of the cleaner system of FIG. 16 viewed from the rear.

Referring to FIG. 17 as a preferred embodiment, as the cleaner system 1A is viewed from the rear, a first cleaner suction flow path line FP1 and a discharge flow path line FP2 may be arranged in parallel.

Here, the first cleaner suction flow path line FP1 may be an imaginary line which passes through the origin of a circle obtained by cutting, in the radial direction along the longitudinal direction, a flow path arranged in parallel to the long axis L of the housing 110 and is perpendicular to the circle.

Meanwhile, the discharge flow path line FP2 may be an imaginary line which passes through the origin of a circle obtained by cutting the discharge flow path 28 in the radial direction along the longitudinal direction, and is perpendicular to the circle.

As such, when a flow path of the sucked air and a flow path of the discharged air are in parallel, flow loss or heat loss of the discharged air when the air flows can be reduced. This produces an effect of improving the drying efficiency of the mop.

In a more preferred embodiment, the first cleaner suction flow path line FP1 and the discharge flow path line FP2 may substantially coincide.

As such, when the flow path of the sucked air and the flow path of the discharged air coincide, flow loss or heat loss of the discharged air when the air flows can be minimized. This produces an effect of maximizing the drying efficiency of the mop.

Also, as the cleaner system 1A is viewed from the rear, a second cleaner suction flow path line FP3 and the discharge flow path line FP2 may be arranged in parallel.

Here, the second cleaner suction flow path line FP3 may be an imaginary line which passes through the origin of a circle obtained by cutting, in the radial direction along the longitudinal direction, a flow path arranged in parallel to the long axis L of the housing 110 among all the flow paths constituting the second cleaner suction flow path 25 and is perpendicular to the circle.

Meanwhile, a flow path switching portion (not shown) may be disposed which changes a flow path on which the suction force of the dust collection motor 130) acts.

When the dust of the first cleaner 50 is sucked, the flow path switching portion may open at least a portion of the first cleaner suction flow path 120 and may close the second cleaner suction flow path 25 such that air can flow through the first cleaner suction flow path 120.

Also, when the dust of the second cleaner 60 is sucked, the flow path switching portion may open the second cleaner suction flow path 25 and may close at least a portion of the first cleaner suction flow path 120 such that air can flow through the second cleaner suction flow path 25.

FIG. 18 is a view showing a bottom surface of the second cleaner 60 which is coupled to the cleaner system 1A of FIG. 16. FIG. 19 is a mimetic diagram of a top surface of the second coupling portion 210 to which the second cleaner 60 is coupled, in the embodiment of FIG. 16.

Referring to FIG. 18, an embodiment of the second cleaner 60 may be a robot cleaner that sucks foreign substances such as dust, etc., on the floor while traveling by itself in an area to be cleaned. In a possible embodiment, the second cleaner 60 may be a robot cleaner having only a suction function. Alternatively, in a possible embodiment, the second cleaner 60 may be a robot cleaner to which a mop 8 is attached and which is capable of suctioning dust and of cleaning with a wet mop. The second cleaner 60 may include a distance sensor for detecting a distance to an obstacle such as furniture, office supplies, or walls installed in a cleaning area and may include left and right wheels for movement. The second cleaner 60 may be coupled to the second station 20. The dust sucked into the dust bin 610 of the second cleaner 60 may be collected in the inner space of the second station 20 through the suction hole 211 of the second station 20 to be described later.

The second cleaner 60 may include the dust discharge hole 620. Here, the dust discharge hole 620 may be disposed on the bottom surface of the dust bin 610 of the second cleaner 60. Through this, the dust bin 610 of the second cleaner 60 and the second cleaner suction flow path 25 to be described later can communicate with each other. For example, the dust discharge hole 620 may have a quadrangular hole shape.

The second cleaner 60 may include a discharge cover 630. Here, the discharge cover 630 may be formed in a shape corresponding to the dust discharge hole 620 and may close the dust discharge hole 620. To this end, the discharge cover 630 may be disposed in the dust discharge hole 620. Also, one side of the discharge cover 630 may be fixed to the dust discharge hole 620, and thus, may form a fixed end, and the other side may form a free end. With this configuration, when a suction force is generated toward the dust bin 610 of the second cleaner 60, the free end may move to open the dust discharge hole 620 while the fixed end is fixed. When the suction force directed toward the dust bin 610 of the second cleaner 60 disappears, the free end of the discharge cover 630 may move to a position that blocks the dust discharge hole 620 again. In this way, according to the moving direction of the free end, the discharge cover 630 may communicate the second cleaner suction flow path 25 and the dust bin 610 of the second cleaner 60 or may close the second cleaner suction flow path 25 and the dust bin 610 of the second cleaner 60.

The second cleaner 60 may include a corresponding terminal 640 for charging the battery when the second cleaner 60 is coupled to the second station 20. The corresponding terminal 640 may be disposed at a position where the corresponding terminal 640 can be connected to a charging terminal of the second station 20 in the state where the second cleaner 60 is coupled to the second station 20. For example, the corresponding terminals 640 may be disposed in the form of a pair on the bottom surface of the second cleaner 60. When the corresponding terminal 640 and the charging terminal 212 of the second station 20 are electrically connected, power is supplied from the second station 20 to the second cleaner 60, and then the second cleaner 60 can be charged.

The second cleaner 60 may include a mop attachment part 650 to and from which the mop 8 is attachable and detachable.

Here, the mop 8 wipes dirt such as dust, etc., on the surface to be cleaned, more specifically, on an indoor floor, and may be separable from the second cleaner 60. The mop 8 is detachably coupled to the mop attachment part 650 and is individually detachable from the mop attachment part 650, thereby making it easier to replace and wash.

Here, the attachment of the mop 8 and the mop attachment part 650 may be made in various ways. For example, the mop 8 may be attached to the bottom surface of the mop attachment part 650 by an attachment called Velcro.

Unlike this, the mop attachment part 650 may be detachably mounted on the bottom surface of the second cleaner 60 by means of a separate coupling structure, so that the mop 8 can be attached to and detached from the second cleaner 60 by attaching and detaching the mop attachment part 650.

Alternatively, not only the mop attachment part 650 can be separably coupled to the bottom surface of the second cleaner 60 by means of a separate coupling structure, but also the mop 8 can also be separably coupled to the mop attachment part 650.

Meanwhile, the second cleaner 60 climbs the top surface of the second coupling portion 210 and then is coupled to the second station 20.

Referring to FIG. 19, the second coupling portion 210 has a structure in which the second cleaner 60 climbs and is coupled to the second coupling portion 210. In a possible embodiment, the second cleaner 60 may approach the second station 20 from the front of the second coupling portion 210 and may climb the second coupling portion 210, and may be seated on the top surface of the second coupling portion 210.

The second coupling portion 210 may have a shape similar to the outer shape of the second cleaner 60. As a possible embodiment, the top surface of the second coupling portion 210 may have a shape similar to a quadrangle. However, the shape of the second coupling portion 210 is not limited thereto and may not be similar to the outer shape of the second cleaner 60 if necessary.

The inner space of the second coupling portion 210 may be formed by the top surface of the second coupling portion 210 that the second cleaner 60 climbs, a side surface of the second coupling portion 210 that extends downward from the edge of the top surface, and a bottom surface of the second coupling portion 210 which is in contact with the floor surface of the room where the second station 20 is installed. At least a portion of the second cleaner suction flow path 25 can be received in the inner space of the second coupling portion 210. At least a portion of the discharge flow path 28 may be received in the inner space of the second coupling portion 210.

On the basis of a state in which the second cleaner 60 is coupled to the second coupling portion 210, the second coupling portion 210 includes the suction hole 211 provided at a position corresponding to the position where the dust bin 610 of the second cleaner 60 is disposed. More specifically, the suction hole 211 is disposed at a position corresponding to the position where the dust discharge hole 620 of the second cleaner 60 is disposed when the second cleaner 60 is coupled to the second station 20. The suction hole 211 may have a shape corresponding to the dust discharge hole 620 of the second cleaner 60. As a possible embodiment, the suction hole 211 may have a quadrangular hole shape.

The second coupling portion 210 may include a second cleaner charging terminal 212 which is electrically connected to the second cleaner 60 and supplies power to charge the second cleaner 60. As the second coupling portion 210 is viewed from the front, one second cleaner charging terminal 212 may be provided on the left and right sides of the second coupling portion 210. When the second cleaner 60 is coupled to the second coupling portion 210, the corresponding terminal 640 of the second cleaner 60 and the second cleaner charging terminals 212 on the left and right sides are electrically connected, a power module (not shown) provided within the second station 20 supplies power to the second cleaner 60 so that the second cleaner 60 can be charged.

In the second coupling portion 210, a discharge portion 213 may be provided in correspondence to the position where the mop 8 attached and coupled to the second cleaner 60 is disposed when the second cleaner 60 is coupled to the second station 20. In the discharge portion 213, air discharged through the discharge flow path 28 may be discharged toward the top portion of the second coupling portion 210. To this end, the discharge portion 213 may include a plurality of holes. As a possible embodiment, the discharge portion 213 may be composed of a mesh member.

With this configuration, in the process of sucking the dust of the dust bin 516 or 610 of the first cleaner 50 or the second cleaner 60, since air to be discharged to the outside of the cleaner system 1A is discharged to the bottom surface of the second cleaner 60 through the discharge portion 213, the mop attached to the second cleaner 60 can be dried. Accordingly, even when the mop that has not been separated immediately after the second cleaner 60 completes cleaning is left for a long time, it is possible to prevent the grow of bacteria or generation of odor in the mop. That is, the convenience of hygienically managing the second cleaner 60 can be provided to the user.

Meanwhile, the discharge portion 213 may be provided only in one portion of the second coupling portion 210. More specifically, the discharge portion 213 is provided only at a position corresponding to the mop 8 attached to the second cleaner 60 on the basis of the state in which the second cleaner 60 is coupled to the second station 20.

With this configuration, the discharge air is provided intensively only to the mop 8, so that the drying efficiency of the mop 8 can be increased.

On the basis of the state in which the second cleaner 60 is coupled to the second station 20, the discharge portion 213 may be provided to have an area wider than an area in the second coupling unit 210 occupied by the mop 8 attached to the second cleaner 60. More specifically, a length L1 of the discharge portion 213 may be greater than a length L2 of the mop and a width D1 of the discharge portion 213 may be greater than a width D2 of the mop.

With this configuration, since the discharge portion 213 can cover the entire area of the mop 8 and can provide the discharge air, all areas of the mop 8 can be uniformly dried.

FIG. 20 is a side view showing schematically another embodiment of a cleaner system 1B including a discharge flow path 48.

Referring to FIG. 20, the cleaner system 1B according to another embodiment of the present disclosure may include a first station 30 and a second station 40.

Here, the configuration of the first cleaner 50 coupled to the first station 30 is the same as that described in the embodiment of FIG. 1. Therefore, descriptions thereof will be omitted herein.

The first station 30 may be coupled to the first cleaner 50. Dust sucked from the inside of the dust bin 516 of the first cleaner 50 may be stored within the first station 30. Also, the first station 30 may include a housing 310 which has an inner space for receiving a plurality of parts provided for this purpose.

The first station 30 may include a first cleaner suction flow path 320.

The first cleaner suction flow path 320 may be received in an inner space of the housing 310. The first cleaner suction flow path 320 may be arranged within the housing 310 in the up and down direction. The arrangement direction of the first cleaner suction flow path 320 may be substantially parallel to the long axis L of the housing 310. The first cleaner suction flow path 320 may have a space therein formed in a shape of a tube having a passage through which dust of the dust bin 516 of the first cleaner 50 moves.

Unlike the embodiment of FIG. 15, the cleaner system 1B according to the embodiment of the present disclosure does not include the second cleaner suction flow path 25. Therefore, the first cleaner suction flow path 320 in this embodiment is different from the first cleaner suction flow path 120 according to the embodiment of FIG. 15 in that the first cleaner suction flow path 320 is not coupled to the second cleaner suction flow path 25.

The housing 310, a dust collection motor 330, a dust collector 340, a door unit 350, a fixing unit 360, and a cover opening unit 370 which are components of the first station 30 are the same as the housing 110, the dust collection motor 130, the dust collector 140, the door unit 150, the fixing unit 160, and the cover opening unit 170, respectively, described in the first station 10 according to the embodiment of FIG. 1. Therefore, descriptions thereof will be omitted herein.

The second station 40 may be coupled to a second cleaner 70. The second station 40 may be disposed below the first station 30 and may be coupled to the first station 30.

The second station 40 may include a second coupling portion 410 where the second cleaner 70 climbs and is coupled to the top of the second coupling portion. The configuration of the second station 40 except for the second coupling portion 410 is the same as that described in the cleaner system 1A according to the embodiment of FIG. 16. Therefore, descriptions thereof will be omitted herein. The second coupling portion 410 will be described later in detail with reference to FIG. 23.

The cleaner system 1B according to another embodiment of the present disclosure may further include the discharge flow path 48.

Referring back to FIG. 20, the discharge flow path 48 may be provided to discharge air sucked from the inside of the dust bin 516 of the first cleaner 50. In the cleaner system 1B according to another embodiment of the present disclosure, since dust is not sucked from the second cleaner 70, the discharge flow path 48 act as a passage through which the air sucked by the first cleaner 50 is discharged.

One side of the discharge flow path 48 may be connected to the housing 310 of the first station 30 and the other side may be connected to the second station 40. More specifically, the other side of the discharge flow path 48 may be connected to an inner space of the second coupling portion 410, and thus, the discharged air may be discharged toward the bottom surface of the second cleaner 70.

For example, one side end of the discharge flow path 48 may be formed in a tubular shape in which one side end is disposed below the dust collection motor 330 within the housing 310 and the other side end extends into the inner space of the second coupling portion 410.

As another example, a hole may be formed at the lower portion of the housing 310, and the discharge flow path 48 may be formed in a tubular shape in which one side end is disposed in the hole and the other side end extends into the inner space of the second coupling portion 410.

FIG. 21 is a view of the cleaner system of FIG. 20 viewed from the rear.

Referring to FIG. 21 as a preferred embodiment, as the cleaner system 1B is viewed from the rear, a first cleaner suction flow path line FP4 and a discharge flow path line FP5 may be arranged in parallel.

Here, the first cleaner suction flow path line FP4 may be an imaginary line which passes through the origin of a circle obtained by cutting, in the radial direction along the longitudinal direction, a flow path arranged in parallel to the long axis L of the housing 310 and is perpendicular to the circle.

Meanwhile, the discharge flow path line FP5 may be an imaginary line which passes through the origin of a circle obtained by cutting the discharge flow path 48 in the radial direction along the longitudinal direction, and is perpendicular to the circle.

As such, when a flow path of the sucked air and a flow path of the discharged air are in parallel, flow loss or heat loss of the discharged air when the air flows can be reduced. This produces an effect of improving the drying efficiency of the mop.

In a more preferred embodiment, the first cleaner suction flow path line FP4 and the discharge flow path line FP5 may substantially coincide.

As such, when the flow path of the sucked air and the flow path of the discharged air coincide, flow loss or heat loss of the discharged air when the air flows can be minimized. This produces an effect of maximizing the drying efficiency of the mop.

FIG. 22 is a view showing the bottom surface of the second cleaner 70 which is coupled to the second station 40, in the embodiment of FIG. 20. FIG. 23 is a view showing the second coupling portion 410 of the second station 40 to which the second cleaner 70 is coupled, in the embodiment of FIG. 20.

Referring to FIG. 22, the second cleaner 70 coupled to the second station 40 may be a robot cleaner exclusively used for wet mop, which automatically cleans, by using rotating mops 9*a* and 9*b*, an area to be cleaned while traveling by itself in the area. The second cleaner 70 may include a distance sensor for detecting a distance to an obstacle such as furniture, office supplies, or walls installed in a cleaning area.

The second cleaner 70 may include a first rotating plate 710*a* and a second rotating plate 710*b* in order to move by using the rotation of the mops 9*a* or 9*b* attached to the bottom surface of a body of the second cleaner 70.

The first rotating plate 710*a* and the second rotating plate 710*b* may have a predetermined area and may be formed in the form of a flat plate, a flat frame, or the like. The first rotating plate 710*a* and the second rotating plate 710*b* are generally laid horizontally, and thus, the first rotating plate 710*a* and the second rotating plate 710*b* may be formed in a form in which a horizontal width (or diameter) thereof is sufficiently greater than an up and down height thereof. The first rotating plate 710*a* and the second rotating plate 710*b* coupled to the bottom surface of the body of the second cleaner 70 may be parallel to a floor surface to be cleaned or may be inclined with the floor surface. The first rotating plate 710*a* and the second rotating plate 710*b* may be formed in a circular plate shape, and the bottom surfaces of the first rotating plate 710*a* and the second rotating plate 710*b* may be generally circular. The first rotating plate 710*a* and the second rotating plate 710*b* may be formed in a rotationally symmetrical shape as a whole.

In the second cleaner 70, if the first rotating plate 710*a* is located on the right side with respect to the bottom surface of the body of the second cleaner 70, the second rotating plate 710*b* may be located on the left side with respect to the bottom surface of the body of the second cleaner 70. Here, the first rotating plate 710*a* and the second rotating plate 710*b* may be symmetrical to each other.

Meanwhile, the first mop 9*a* may be coupled to the first rotating plate 710*a* of the second cleaner 70, and the second mop 9*b* may be coupled to the second rotating plate 710*b*.

The first mop 9*a* and the second mop 9*b* wipe dirt such as dust, etc., on the floor surface, and may be separable from the second cleaner 70. The first mop 9*a* and the second mop 9*b* are detachably coupled to the first rotating plate 710*a* and the second rotating plate 720*b*, respectively, and are individually detachable from the first rotating plate 710*a* and the second rotating plate 720*b*. thereby making it easier to replace and wash.

Here, the attachment of the first mop 9*a* and the second mop 9*b* and the first rotating plate 710*a* and the second rotating plate 720*b* may be made in a variety of ways. For example, the first mop 9*a* and the second mop 9*b* may be attached to the bottom surfaces of the first rotating plate 710*a* and the second rotating plate 720*b* by an attachment called Velcro.

The bottom surfaces of the first mop 9*a* and the second mop 9*b* may be generally circular, and may be formed in a rotationally symmetrical shape as a whole. The first mop 9*a* may be coupled to the first rotating plate 710*a* and rotate together with the first rotating plate 710*a*. In addition, the second mop 9*b* may be coupled to the second rotating plate 710*b* and rotate together with the second rotating plate 710*b*.

When the first rotating plate 710*a* and the second rotating plate 710*b* rotate at the same speed in opposite directions to each other, the second cleaner 70 may move in a straight line and may move forward or backward. When only one of the first rotating plate 710*a* and the second rotating plate 710*b* rotates, the second cleaner 70 may change its direction and turn.

The second cleaner 70 may include a corresponding terminal 720 for charging the battery when the second cleaner 70 is coupled to the second station 40. The corresponding terminal 720 may be disposed at a position where the corresponding terminal 720 can be connected to a charging terminal 412 of the second station 40 in the state where the second cleaner 70 is coupled. For example, the corresponding terminals 720 may be disposed in the form of a pair on the bottom surface of the second cleaner 70. When the corresponding terminal 720 and the charging terminal 412 of the second station 40 are electrically connected, power is supplied from the second station 40 to the second cleaner 70, and then the second cleaner 70 can be charged.

Meanwhile, the second cleaner 70 climbs the top surface of the second coupling portion 410 and then is coupled to the second station 40.

Referring to FIG. 23, the second coupling portion 410 has a structure in which the second cleaner 70 climbs and is coupled to the second coupling portion 410. The second cleaner 70 may approach the second station 40 from the front of the second coupling portion 410 and may climb the second coupling portion 410, and may be seated on the top surface of the second coupling portion 410.

The second coupling portion 410 may have a shape similar to the outer shape of the second cleaner 70. For example, the second coupling portion 410 may have a shape similar to a circle. However, the shape of the second coupling portion 410 is not limited thereto and may not be similar to the outer shape of the second cleaner 70 if necessary.

The inner space of the second coupling portion 410 may be formed by the top surface of the second coupling portion 210 that the second cleaner 70 climbs, a side surface of the second coupling portion 410 that extends downward from the edge of the top surface, and a bottom surface of the second coupling portion 410 which is in contact with the floor surface of the room where the second station 40 is installed. At least a portion of the discharge flow path 48 may be received in the inner space of the second coupling portion 410.

The second coupling portion 410 may include a second cleaner charging terminal 412 which is electrically connected to the second cleaner 70 and supplies power to charge the second cleaner 70. As the second coupling portion 410 is viewed from the front, one second cleaner charging terminal 412 may be provided on the left and right sides of the second coupling portion 410. When the second cleaner 70 is coupled to the second coupling portion 410, the corresponding terminal 740 of the second cleaner 70 and the second cleaner charging terminals 412 on the left and right sides are electrically connected, a power module (not shown) provided within the second station 40 supplies power to the second cleaner 70 so that the second cleaner 70 can be charged.

In the second coupling part 410, a discharge portion 413 may be provided in correspondence to the position where the mops 9*a* and 9*b* attached and coupled to the second cleaner 70 is disposed when the second cleaner 70 is coupled to the second station 40. In the discharge portion 413, air discharged through the discharge flow path 48 may be discharged toward the top portion of the second coupling portion 410. To this end, the discharge portion 413 may include a plurality of holes. As a possible embodiment, the discharge portion 413 may be composed of a mesh member.

With this configuration, in the process of sucking the dust of the dust bin 516 of the first cleaner 50, since air to be discharged to the outside of the cleaner system 1B is discharged to the bottom surface of the second cleaner 70 through the discharge portion 413, the mops 9*a* and 9*b* attached to the second cleaner 70 can be dried. Accordingly, even when the mops 9*a* and 9*b* that have not been separated immediately after the second cleaner 70 completes cleaning is left for a long time, it is possible to prevent the grow of bacteria or generation of odor in the mops 9*a* and 9*b*. That is, the convenience of hygienically managing the second cleaner 70 can be provided to the user.

Meanwhile, the discharge portion 413 may be provided only in one portion of the second coupling portion 410. More specifically, the discharge portion 413 is provided only at a position corresponding to the mops 9*a* and 9*b* attached to the second cleaner 70 on the basis of the state in which the second cleaner 70 is coupled to the second station 40.

With this configuration, the discharge air is provided intensively only to the mops 9*a* and 9*b*, so that the drying efficiency of the mops 9*a* and 9*b* can be increased.

On the basis of the state in which the second cleaner 70 is coupled to the second station 40, the discharge portion 413 may be provided to have an area wider than an area in the second coupling unit 410 occupied by the mops 9*a* and 9*b* attached to the second cleaner 70. More specifically, a length L4 of the discharge portion 4 may be greater than a length L3 obtained by summing diameters of the first mop 9*a* and the second mop 9*b* and a width D4 of the discharge portion 413 may be greater than a width D3 of the first mop 9*a* or the second mop 9*b*.

With this configuration, since the discharge portion 413 can cover the entire area where the first mop 9*a* and the second mop 9*b* are disposed and can provide the discharge air, all areas of the mops 9*a* and 9*b* can be uniformly dried.

As described above, according to the embodiment of the present disclosure, the first station to which the first cleaner is coupled and the second station to which the second cleaner is coupled are included, so that it is possible to remove the inconvenience for a user to empty the dust in the dust bin of the first cleaner and/or the second cleaner each time.

In addition, according to the embodiment of the present disclosure, in a state in which the first cleaner is coupled to the first station and the second cleaner is coupled to the second station, components are arranged such that the overall balance of the cleaner system is maintained, and therefore, each cleaner and station can be supported stably without being biased to one side.

In addition, according to the embodiment of the present disclosure, air sucked in the process of sucking dust of the dust bin of the first cleaner and/or the second cleaner is discharged toward the bottom of the second cleaner, thereby drying the mop attached to the second cleaner. Accordingly, user convenience that allows hygienic management of the second cleaner can be provided.

Although the foregoing has described a specific embodiment of the present disclosure, it can be understood by those skilled in the art that the present disclosure is not limited to the illustrated embodiment and can be variously changed and modified to other specific embodiments without departing from the spirit and scope of the present disclosure. Therefore, the scope of the present disclosure should be determined not by the described embodiments but by the spirit as defined by the appended claims.

The invention claimed is:

1. A cleaner system comprising:

a first cleaner that includes a suction portion which sucks dust-containing air through an extension tube through which air flows, a suction motor which generates a suction force for sucking air along the suction portion, and a dust bin which stores dust separated from the sucked air;

a first station that includes a housing which has an inner space and to which the first cleaner is coupled, a first coupling portion which is formed in the housing and to which the dust bin is coupled, and a dust collection motor which is disposed in the inner space and generates a suction force sucking the dust within the dust bin into the housing;

a second station that is coupled below the first station and includes a second coupling portion to which a second cleaner climbs; and an imaginary plane that includes an extension tube through-line passing through the extension tube in a longitudinal direction and an imaginary suction motor axial line obtained by extending a rotational axis of the suction motor, wherein the second cleaner is a cleaner that autonomously travels in an area to be cleaned, and wherein, in a state where the first cleaner is coupled to the first coupling portion and the second cleaner is coupled to the second coupling portion, at least a portion of the suction motor or the dust bin of the first cleaner is located directly above the dust collection motor along a vertical direction, such that the dust can flow downwards from the dust bin toward the dust collection motor due to gravity.

2. The cleaner system of claim 1, wherein the first cleaner further comprises a handle having a grip portion that is disposed in an opposite direction to the suction portion such that a user grips the first cleaner, and wherein the plane comprises an imaginary grip portion through-line that is formed in a longitudinal direction of the grip portion and passes through an inside of the grip portion.

3. The cleaner system of claim 1, wherein the plane passes through at least a portion of the first station in the state in which the first cleaner is coupled to the first station, and wherein the extension tube through-line crosses the suction motor axial line.

4. The cleaner system of claim 1, wherein the plane passes through at least a portion of the dust collection motor in the state in which the first cleaner is coupled to the first station.

5. The cleaner system of claim 1, wherein the plane comprises an imaginary dust collection motor axial line obtained by extending a rotational axis of the dust collection motor.

6. The cleaner system of claim 1, further comprising an imaginary second cleaner centerline which passes through a center of gravity of the second cleaner and is orthogonal to a bottom surface of the second cleaner, wherein, when the second cleaner is coupled to the second station, the second cleaner centerline is disposed within a width of the dust collection motor as the first station is viewed from the front.

7. The cleaner system of claim 1, wherein a center of gravity of the second cleaner is disposed behind a center of gravity of the suction motor in the state where the first cleaner is coupled to the first station and the second cleaner is coupled to the second station.

8. The cleaner system of claim 1, wherein a center of gravity of the second cleaner is disposed between a center of gravity of the suction motor and a center of gravity of the dust collection motor in the state where the first cleaner is coupled to the first station and the second cleaner is coupled to the second station.

9. A cleaner system comprising:

a first station that includes a housing which has an inner space and to which a first cleaner is coupled and a first cleaner suction flow path which sucks dust within a dust bin of the first cleaner;

a second station that is coupled below the first station and includes a second coupling portion to which a second cleaner climbs;

a second cleaner suction flow path of which one side is coupled to the second station to suck dust within a dust bin of the second cleaner and of which other side is coupled to the first cleaner suction flow path;

a discharge flow path that is provided to discharge air sucked from the first cleaner or the second cleaner, wherein the second cleaner is a cleaner that autonomously travels in an area to be cleaned, and wherein one side of the discharge flow path is connected to the housing and the other side of the discharge flow path is connected to the second station, so that air is discharged toward a bottom surface of the second cleaner.

10. The cleaner system of claim 9, wherein the second coupling portion is provided with a discharge portion such that air discharged through the discharge flow path is discharged toward a top portion of the second coupling portion.

11. The cleaner system of claim 9, wherein the second coupling portion comprises a suction hole which is disposed at a position corresponding to a position where the dust bin of the second cleaner is disposed, on the basis of a state in which the second cleaner is coupled to the second coupling portion, and sucks air from the dust bin of the second cleaner.

12. The cleaner system of claim 11, wherein one side of the second cleaner suction flow path is coupled to the suction hole such that the second cleaner suction flow path sucks the dust within the dust bin of the second cleaner.

13. The cleaner system of claim 9, wherein the discharge portion is disposed at a position corresponding to a mop attached to the second cleaner, on the basis of a state in which the second cleaner is coupled to the second station.

14. The cleaner system of claim 9, wherein the discharge portion is provided to have an area wider than an area in the second coupling unit occupied by a mop attached to the second cleaner, on the basis of a state in which the second cleaner is coupled to the second station.

15. A cleaner system comprising:

a first station that includes a housing which has an inner space and to which a first cleaner is coupled and a first cleaner suction flow path which sucks dust within a dust bin of the first cleaner;

a second station that is coupled below the first station and includes a second coupling portion to which a second cleaner climbs; and a discharge flow path that is provided to discharge air sucked from the first cleaner or the second cleaner, wherein the second cleaner is a cleaner that autonomously travels in an area to be cleaned, and wherein one side of the discharge flow path is connected to the housing and the other side of the discharge flow path is connected to the second station, so that air is discharged toward a bottom surface of the second cleaner.

16. The cleaner system of claim 15, wherein the second coupling portion is provided with a discharge portion such that air discharged through the discharge flow path is discharged toward a top portion of the second coupling portion.

17. The cleaner system of claim 16, wherein the discharge portion is disposed at a position corresponding to a mop attached to the second cleaner, on the basis of a state in which the second cleaner is coupled to the second station.

18. The cleaner system of claim 16, wherein the discharge portion is provided to have an area wider than an area in the second coupling unit occupied by a mop attached to the second cleaner, on the basis of a state in which the second cleaner is coupled to the second station.

* * * * *